US007950556B2

(12) United States Patent
Hagan

(10) Patent No.: US 7,950,556 B2
(45) **Date of Patent: *May 31, 2011**

(54) COIL NAIL SPREADER

(75) Inventor: Todd A Hagan, Windsor, PA (US)

(73) Assignee: Black & Decker Inc., Newark, DE (US)

( * ) Notice: Subject to any disclaimer, the term of this patent is extended or adjusted under 35 U.S.C. 154(b) by 1450 days.

This patent is subject to a terminal disclaimer.

(21) Appl. No.: 11/082,002

(22) Filed: Mar. 16, 2005

(65) Prior Publication Data

US 2006/0208027 A1 Sep. 21, 2006

(51) Int. Cl.
*B25C 5/06* (2006.01)

(52) U.S. Cl. ..... 227/128

(58) Field of Classification Search ..... 227/120, 227/127, 135, 136, 137, 128, 129, 130, 114, 227/112; 29/606

See application file for complete search history.

(56) References Cited

U.S. PATENT DOCUMENTS

| | | | | |
|---|---|---|---|---|
| 2,923,937 | A | 2/1960 | Laucher | |
| 3,330,462 | A | 7/1967 | Colechia et al. | |
| 3,353,737 | A | 11/1967 | Howard et al. | |
| 3,524,576 | A | 8/1970 | Bader | |
| 3,543,987 | A | 12/1970 | Obergfell et al. | |
| 3,622,062 | A | 11/1971 | Goode, Jr. et al. | |
| 3,636,707 | A | 1/1972 | Saari et al. | |
| 3,672,029 | A | 6/1972 | Butriss | |
| 3,688,966 | A | 9/1972 | Perkins et al. | |
| 3,703,981 | A | 11/1972 | Smith | |
| 3,708,097 | A | 1/1973 | Fisher | |
| 3,803,840 | A | 4/1974 | Toczycki | |
| 3,858,780 | A | 1/1975 | Perkins et al. | |
| 3,893,610 | A | 7/1975 | Smith | |
| 3,945,551 | A | 3/1976 | Sato et al. | |
| 4,053,094 | A | 10/1977 | Males | |
| 4,149,297 | A | 4/1979 | Monacelli | |
| 4,270,687 | A | 6/1981 | Mauer | |
| 4,313,552 | A | 2/1982 | Mauer | |
| 4,319,705 | A * | 3/1982 | Geist et al. | 227/120 |
| 4,442,965 | A | 4/1984 | Leistner | |
| 4,549,681 | A | 10/1985 | Yamamoto et al. | |

(Continued)

FOREIGN PATENT DOCUMENTS

DE 22 13 102 10/1972

(Continued)

OTHER PUBLICATIONS

Parts Reference Guide (SCN40R), Senco Products, Inc., Cincinnati, OH 45244.

*Primary Examiner* — Brian D Nash

(74) *Attorney, Agent, or Firm* — Harness, Dickey & Pierce, P.L.C.

(57) ABSTRACT

A fastening tool includes a housing assembly having a nosepiece and a magazine assembly that is coupled to the housing assembly. The magazine assembly includes a canister configured to hold a plurality of collated fasteners. The fastening tool further includes a feeder pawl assembly coupled to the magazine assembly. The feeder pawl assembly includes a feed pawl and a spreader pawl. The feed pawl is movable in the feed direction to advance a first fastener into the nosepiece during a feed motion. The spreader pawl is adapted to locate between adjacent fasteners and resist movement of one of the adjacent fasteners in the feed direction during the feed motion.

10 Claims, 18 Drawing Sheets

U.S. PATENT DOCUMENTS

| | | | | |
|---|---|---|---|---|
| 4,597,517 | A | 7/1986 | Wagdy | |
| 4,600,135 | A | 7/1986 | Mukoyama | |
| 4,856,696 | A | 8/1989 | Seld | |
| 4,863,089 | A | 9/1989 | McCardle et al. | |
| 4,875,745 | A | 10/1989 | Trulaske | |
| 4,909,419 | A | 3/1990 | Yamada et al. | |
| 4,942,996 | A | 7/1990 | Wolfberg et al. | |
| 5,004,141 | A | 4/1991 | Young et al. | |
| 5,207,679 | A | 5/1993 | Li | |
| 5,240,161 | A | 8/1993 | Kaneko | |
| 5,332,141 | A | 7/1994 | Mukoyama et al. | |
| 5,522,533 | A | 6/1996 | Mukoyama et al. | |
| 5,558,264 | A | 9/1996 | Weinstein | |
| 5,683,024 | A | 11/1997 | Eminger et al. | |
| 5,738,266 | A | 4/1998 | Ogawa | |
| 5,772,089 | A | 6/1998 | Parsons et al. | |
| 6,006,975 | A | 12/1999 | Ishizawa | |
| 6,032,848 | A | 3/2000 | Smolinski | |
| 6,041,992 | A | 3/2000 | Poinelli et al. | |
| 6,152,346 | A | 11/2000 | Laubach | |
| 6,308,880 | B1 | 10/2001 | Ronconi | |
| 6,422,447 | B1 | 7/2002 | White et al. | |
| 6,431,430 | B1 | 8/2002 | Jalbert et al. | |
| 6,499,642 | B1 | 12/2002 | Amada | |
| 2002/0060234 | A1 | 5/2002 | Osuga et al. | |
| 2002/0117531 | A1 | 8/2002 | Schell et al. | |
| 2003/0071103 | A1 | 4/2003 | Amada | |
| 2003/0071104 | A1 | 4/2003 | Amada | |
| 2005/0023323 | A1* | 2/2005 | Jalbert et al. | 227/137 |
| 2005/0263559 | A1* | 12/2005 | Hagan et al. | 227/135 |
| 2006/0118596 | A1* | 6/2006 | Wojcicki et al. | 227/137 |

FOREIGN PATENT DOCUMENTS

| | | |
|---|---|---|
| DE | 21 58 674 | 12/1975 |
| DE | 24 39 147 | 9/1977 |
| DE | 27 37 602 | 3/1979 |
| DE | 22 48 956 | 4/1981 |
| DE | 43 00 871 | 7/1994 |
| WO | WO 01/87545 | 11/2001 |
| WO | WO 02/14026 | 2/2002 |

* cited by examiner

COIL NAIL SPREADER

INTRODUCTION

The present invention generally relates to fastening tools including nailers. More particularly, the present invention generally relates to magazine assemblies for fastening tools and methods for loading magazine assemblies.

Coil nailers are known in the art for performing tasks such as attaching asphalt shingles to a roof or for attaching vinyl siding to an exterior wall of a building. Such nailers typically include a drum for storing a coil of collated fasteners and a feed mechanism for feeding the fasteners into nosepiece of the fastening tool. While the known coil nailers are suitable for their intended purpose, we have found that they are nonetheless susceptible to improvement.

For example, the feeding of the fasteners from the drum into the nosepiece is typically facilitated by cooperation of one or more pawls that sequentially feed the fasteners into the nosepiece where they may be fired. In some instances during operation of the tool, adjacent fasteners of the coil may become too close together. As a result, a pawl may not have enough clearance to locate between adjacent fasteners to prepare for a subsequent feed motion. In such a case, the feed assembly may become jammed requiring a user to gain access to the feed assembly and related fasteners of the coil to rectify the problem. Accordingly, there remains a need for an improved feeder pawl assembly.

SUMMARY

In one form, the present teachings provide a fastening tool that includes a housing assembly having a nosepiece and a magazine assembly that is coupled to the housing assembly. The magazine assembly includes a canister configured to hold a plurality of collated fasteners. The fastening tool further includes a feeder pawl assembly coupled to the magazine assembly. The feeder pawl assembly includes a feed pawl and a spreader pawl. The feed pawl is movable in the feed direction to advance a first fastener into the nosepiece during a feed motion. The spreader pawl is adapted to locate between adjacent fasteners and resist movement of one of the adjacent fasteners in the feed direction during the feed motion.

According to other features, the spreader pawl includes a body portion having a finger portion extending therefrom. The spreader pawl is movable between an engaged position wherein the finger portion impedes movement of an adjacent fastener toward the nosepiece and a disengaged position wherein the finger portion permits movement of an adjacent fastener toward the nosepiece. The spreader pawl is pivotally mounted at a pivot joint to the magazine assembly and biased toward the engaged position. The finger portion of the spreader pawl is disposed on an end of the body portion opposite the pivot joint. The feed pawl pivots the spreader pawl to the disengaged position upon movement of the feed pawl in the retract direction.

In another form, the present teachings provide a spreader pawl having a finger portion disposed on an intermediate portion of a body portion. A trailing surface of the finger portion of the spreader pawl defines a generally perpendicular surface relative to an axis of the spreader pawl. The spreader pawl progressively ramps over the adjacent fastener during the resisting of movement of the adjacent fastener.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

Additional advantages and features of the present invention will become apparent from the subsequent description and the appended claims, taken in conjunction with the accompanying drawings, wherein:

The present invention will become more fully understood from the detailed description and the accompanying drawings, wherein;

DETAILED DESCRIPTION OF THE VARIOUS EMBODIMENTS

Figure 1:
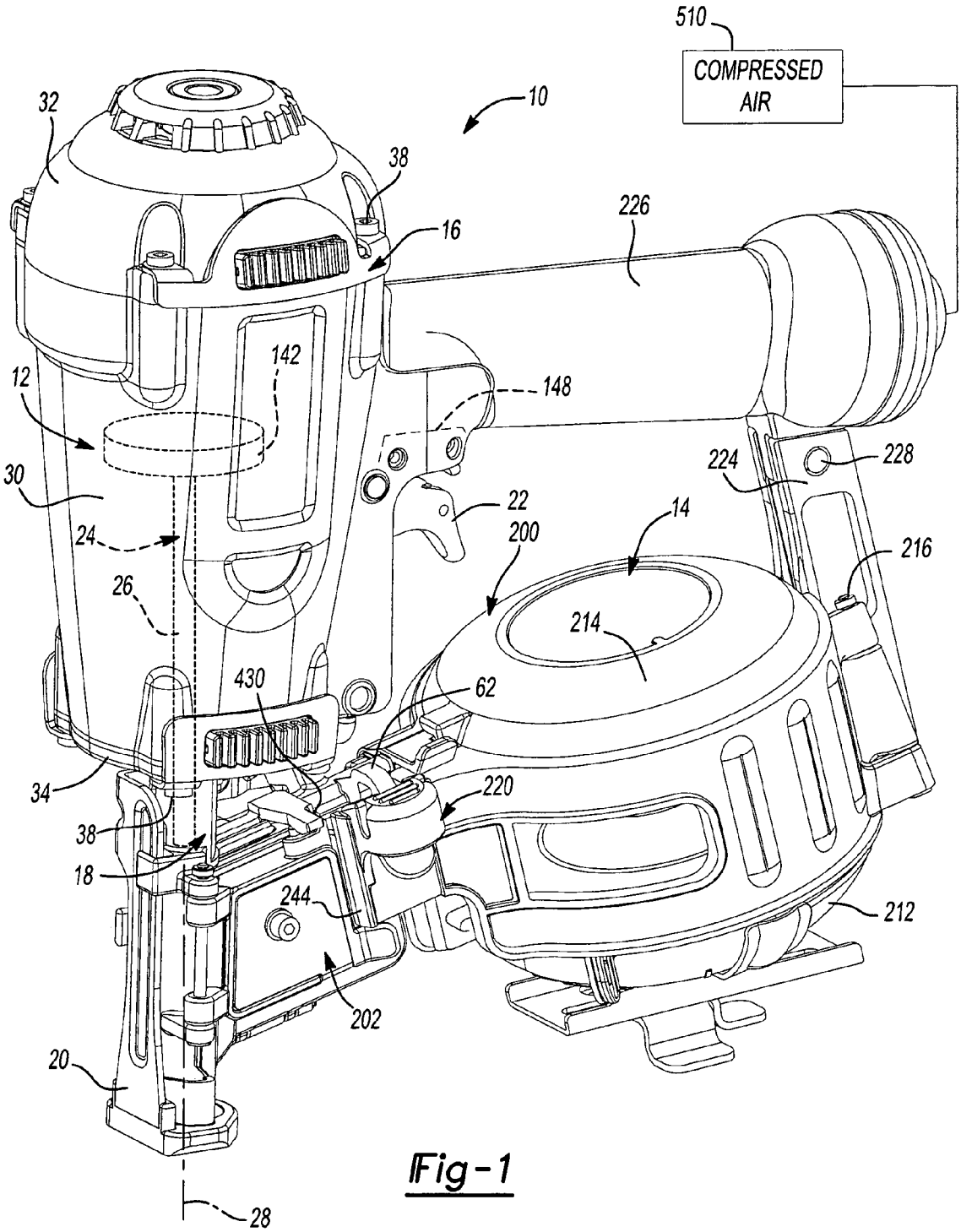
FIG. 1 is a perspective view of a fastening tool constructed in accordance with the teachings of the present invention.

With reference to FIG. 1 of the drawings, a fastening tool constructed in accordance with the teachings of the present invention is generally indicated by reference numeral 10. The fastening tool 10 may include a housing assembly 12 and a magazine assembly 14. The housing assembly 12 may include a housing 16, which may be formed from any appropriate material including aluminum, magnesium and/or plastic, a nosepiece 18, and a contact trip 20. The housing 16 conventionally houses a trigger 22 and a motor 24 with a driver 26 that may be selectively translated along an axis 28 to drive a fastener into a workpiece (not shown). In the particular example provided, the housing 16 includes a central portion 30 and an upper end cap 32, which is configured to close off an upper end of the central portion 30, while the nosepiece 18 includes an upper flange 34 that is configured to close off a lower end of the central portion 30. Conventional fasteners 38, such as socket head cap screws, may be employed to fixedly but removably couple the upper end cap 32 and nosepiece 18 to the central portion 30. While not specifically shown, those of ordinary skill in the art will appreciate that conventional gaskets or seals may be employed to seal the interfaces between the upper end cap 32 and the central portion 30 and between the central portion 30 and the nosepiece 18.

Figure 2:
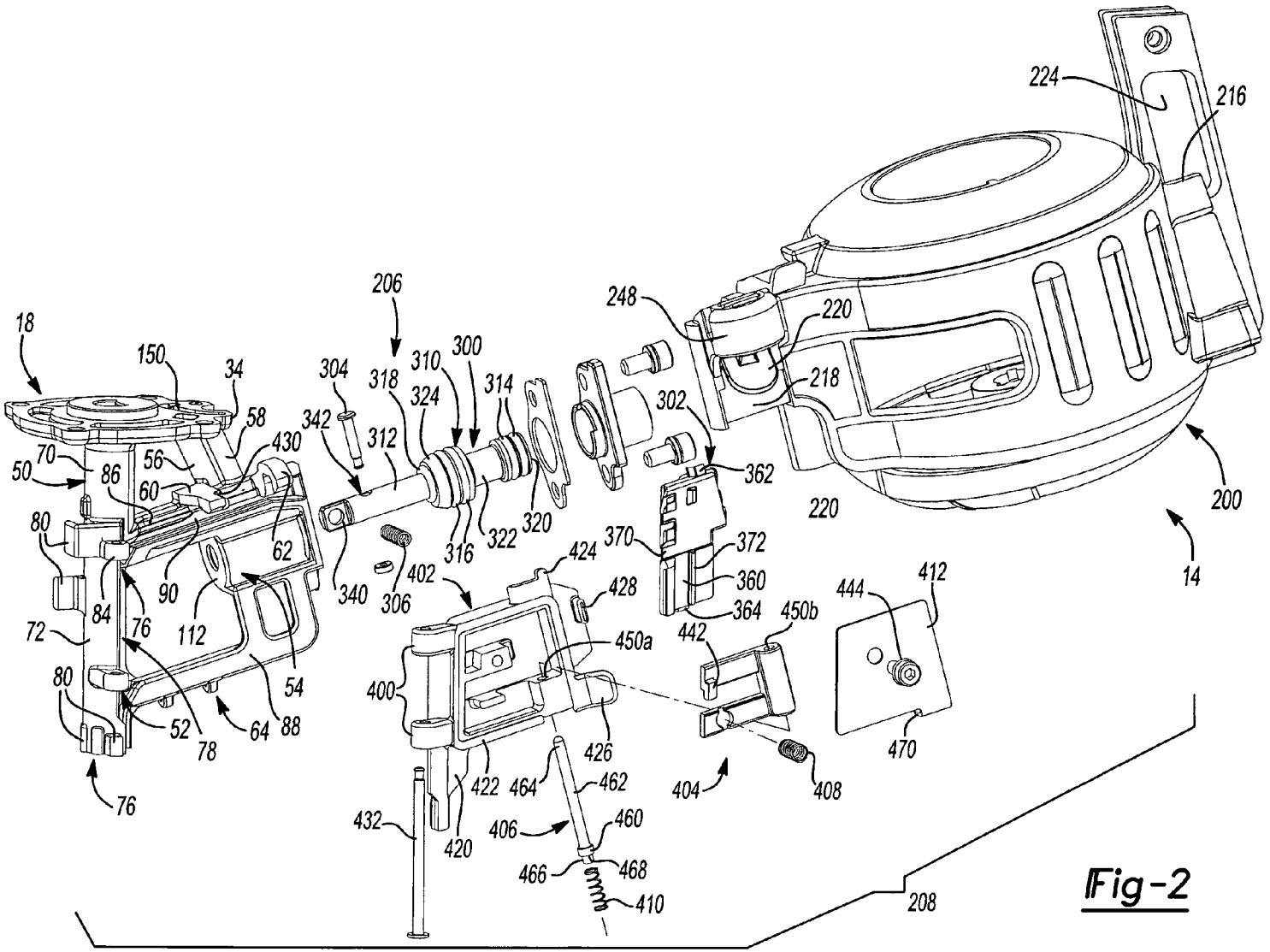
FIG. 2 is an exploded perspective view of a portion of the fastening tool of FIG. 1 illustrating the nosepiece and magazine assembly in greater detail.
Figure 3:
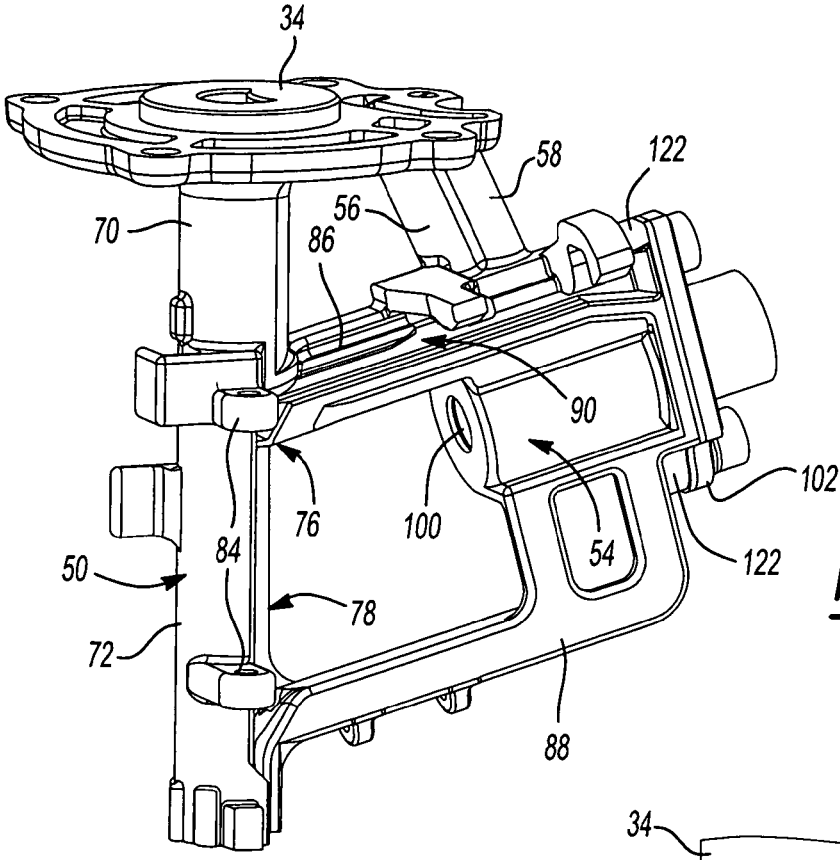
FIG. 3 is a left elevation view of the nosepiece.

With reference to FIGS. 2 and 3, the nosepiece 18 may include the upper flange 34, a barrel 50, a nosepiece hinge mount 52, a feed cylinder 54, first and second feed cylinder conduits 56 and 58, respectively, a magazine latch post 60, a canister latch post 62 and a cover hinge mount 64. The barrel 50 may include a first portion 70, which may be disposed adjacent the upper flange 34, a second portion 72 that may be disposed on a side of the first portion 70 opposite the upper flange 34, and an interior cavity 76 that may extend through the first and second portions 70 and 72. The first portion 70 may have a closed perimeter that encloses the interior cavity 76, whereas the second portion 72 has an open perimeter that forms an opening 78 that permits the fasteners (not shown) to be fed into the interior cavity 76. The barrel 50 may also include one or more guides that guide or restrict the movement of a lower contact trip 80 along the barrel 50.

The nosepiece hinge mount 52 may include a pair of trunnion mounts 84 that extend from the barrel 50 proximate the opening 78 in the second portion 72. The first and second feed cylinder conduits 56 and 58 may couple the feed cylinder 54 to the upper flange 34, while first and second support legs 86 and 88, respectively, may couple the feed cylinder 54 to the barrel 50. The first support leg 86 may define a guide track 90 that may be configured to receive the heads (not shown) of the collated fasteners (not shown) as the collated fasteners are fed into the barrel 50.

The feed cylinder 54 may include a feed cylinder structure 100 and a feed cylinder end cap 102. The feed cylinder structure 100 may define a body portion 110, a first flange 112 and a second flange 114. The body portion 110 may be generally cylindrically shaped and may define a cylindrical bore 116. The first flange 112 may be located on a first end of the body portion 110 and may define a rod aperture 118 and a seal recess 120 that are concentric with the bore 116. The second flange 114 may include a pair of bosses 122 that may be employed to fixedly but removably couple the feed cylinder end cap 102 to the feed cylinder structure 100. The feed cylinder end cap 102 may be configured to extend an end of the bore 116 opposite the first flange 112. In the example provided, the feed cylinder end cap 102 includes a body 130 that defines a bore 132 that is somewhat smaller in diameter than bore 116. The body 130 may be configured to be partially received into the bore 116 so that the bore 132 and the bore 116 are concentric with one another.

With reference to FIGS. 1 and 4 through 6, the first feed cylinder conduit 56 may be configured to supply compressed air from the housing 16 to a first end of the feed cylinder structure 100 while the second feed cylinder conduit 58 is configured to supply compressed air from the housing 16 to a second end of the feed cylinder structure 100. The housing 16 may include a first feed channel 140, which may be coupled in fluid communication to the first feed cylinder conduit 56 and configured to receive compressed air when a piston 142 associated with the motor 24 is moved to a returned position after the driving of a fastener, and a second feed channel 144, which may be coupled in fluid communication to the second feed cylinder conduit 58 and coupled to a main reservoir 146 that supplies compressed air to a trigger valve 148 that is associated with the trigger 22. As the first and second feed channels 140 and 144 are spaced laterally apart from one another, one of the first and second feed cylinder conduits 56 and 58 (e.g., the first feed cylinder conduit 56) may include a portion 150 that is recessed into an upper side of the upper flange 34 as is best shown in FIG. 2. Configuration in this manner permits the portions of the first and second feed cylinder conduits 56 and 58 that are located between the upper flange 34 and the feed cylinder structure 100 to be stacked upon one another for improved strength and reduced casting complexity.

Figure 7:
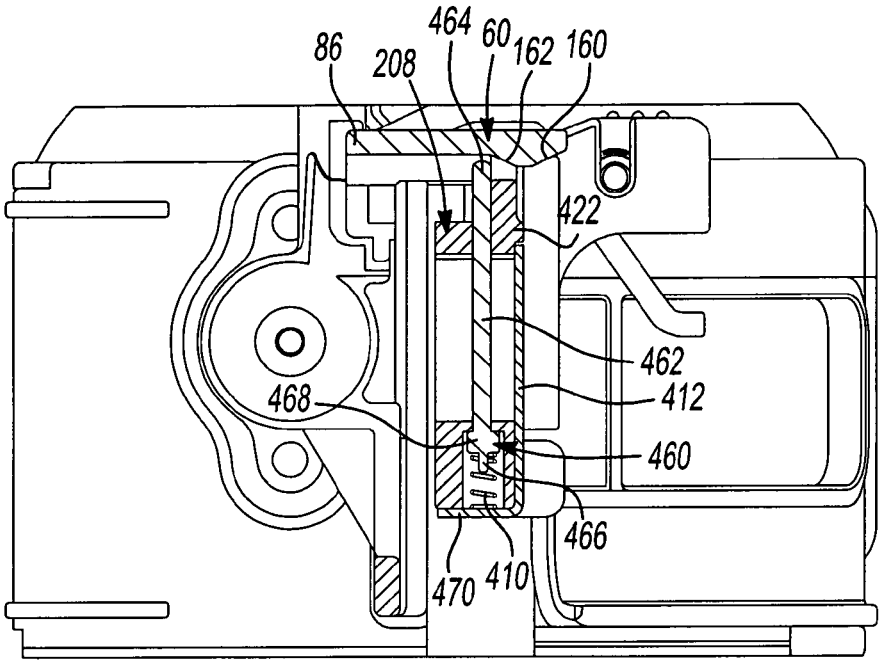
FIG. 7 is a sectional view of a portion of the fastening tool of FIG. 1 illustrating the follower pawl assembly as coupled to the nosepiece.
Figure 8:
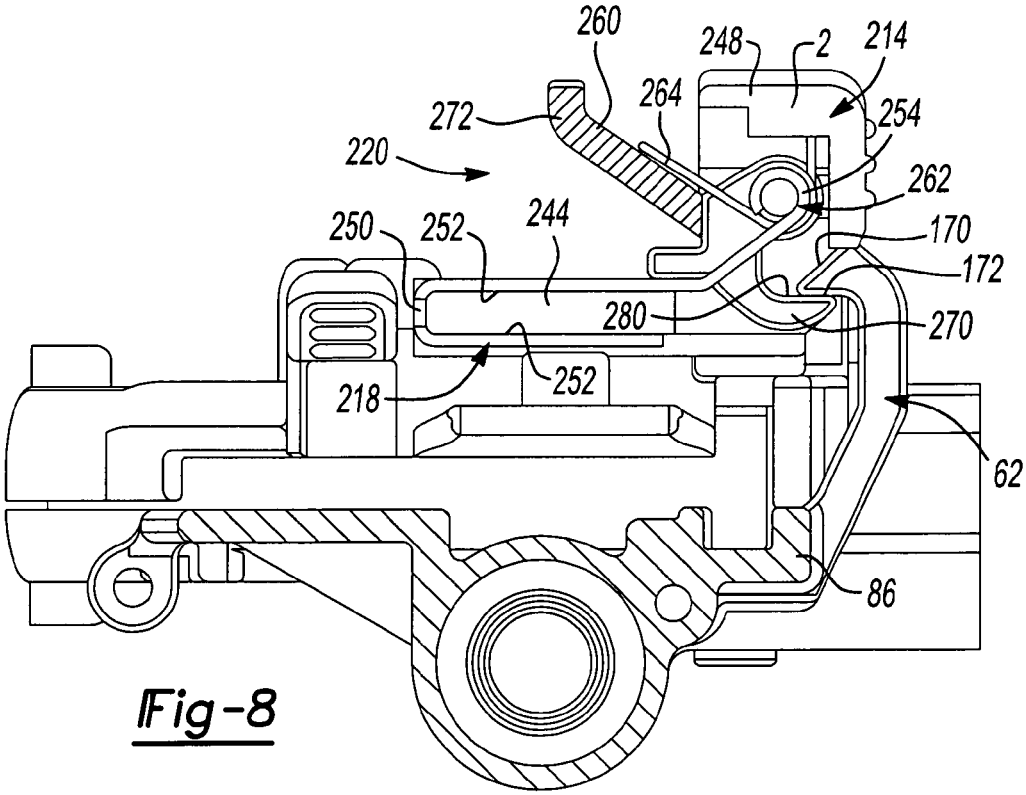
FIG. 8 is a sectional view of a portion of the fastening tool of FIG. 1 illustrating the canister in a closed position and engaged to the nosepiece.

With reference to FIG. 7, the magazine latch post 60 may be coupled to the first support leg 86 and may include a first ramp 160 and a second ramp 162. With reference to FIG. 8, the canister latch post 62 may also be coupled to the first support leg 86 and may include a tapered latch contact 170 and an abutting surface 172. The magazine latch post 60 and the canister latch post 62 will be discussed in further detail, below.

Figure 9:
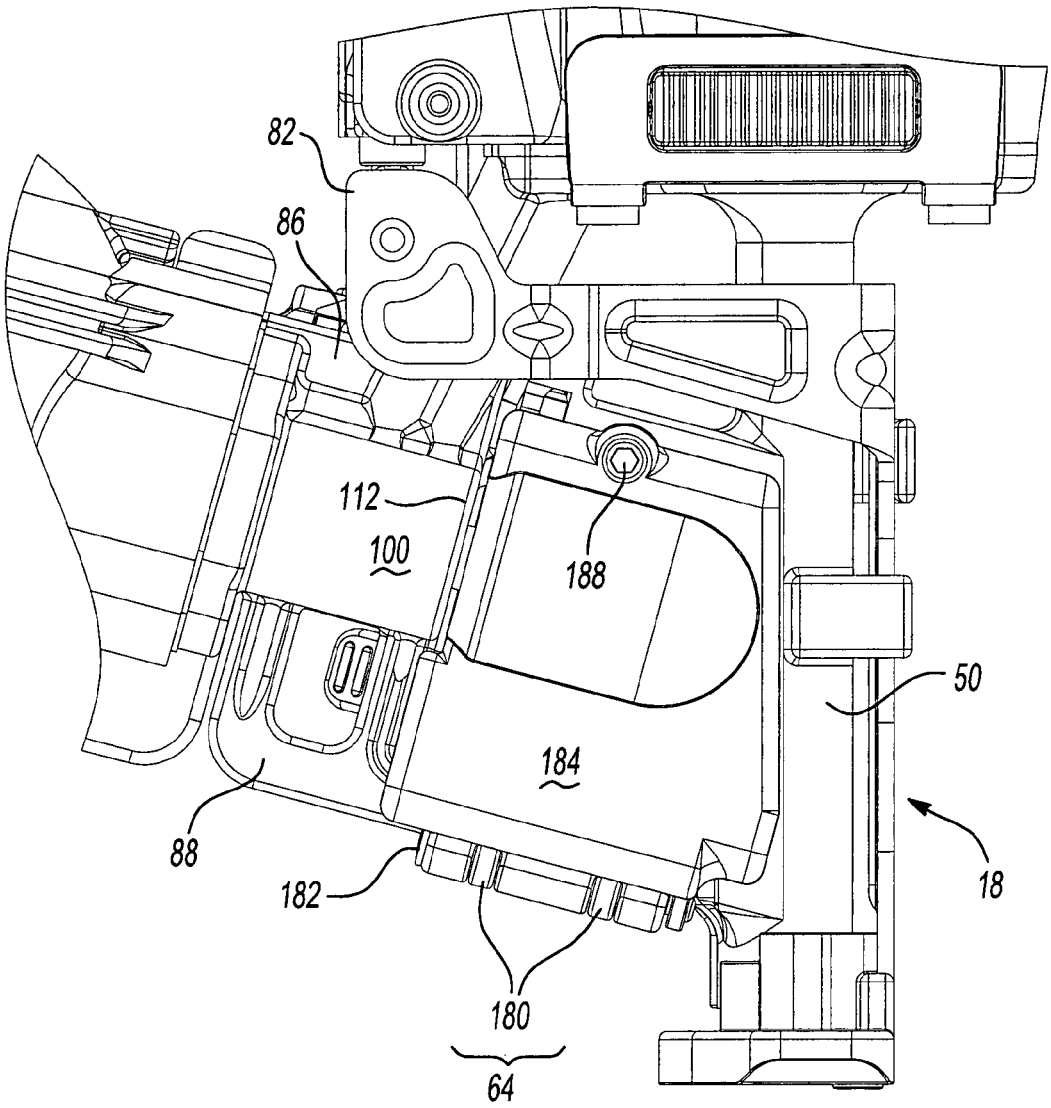
FIG. 9 is a partial right elevation view of the fastening tool of FIG. 1.

With reference to FIGS. 2 and 9, the cover hinge mount 64 may include a pair of trunnion mounts 180 that may be coupled to the second support leg 88 on a side of the nosepiece 18 opposite the nosepiece hinge mount 52. The cover hinge mount 64 may be configured to cooperate with a hinge pin 182 to pivotally couple a cover 184 to the nosepiece 18 in a manner that shrouds a portion of the nosepiece 18 between the first flange 112 of the feed cylinder structure 100 and the barrel 50. The cover 184, which may be positioned in an open position and a closed position (which is illustrated in FIG. 9), may be maintained in the closed position by any suitable means. In the example provided, a threaded fastener 188 is inserted through the cover 184 and threadably engaged to the first support leg 86 to maintain the cover 184 in the closed position.

In FIGS. 1, 2, 10 and 11, the magazine assembly 14, which may be coupled to the housing assembly 12, may be configured to house a plurality of fasteners and sequentially feed the fasteners into the nosepiece 18. The magazine assembly 14 may include a canister 200 for holding coiled, collated nails 500 and a feed mechanism 202, which may include a feed pawl assembly 206 and a follower pawl assembly 208. The canister 200 may include a first canister portion 212, a second canister portion 214, a hinge pin 216, a latch bracket 218 and a canister latch 220. The first canister portion 212 may be fixedly coupled to the housing assembly 12. In the particular example provided, the first canister portion 212 includes a first mount 224, which may be fixedly but removably coupled to a handle 226 of the housing 16 via a threaded fastener 228, and a second mount 234, which may be fitted over a portion of the feed cylinder end cap 102. A vent hole 236 may be formed in the second mount 234 to permit air to enter or exit an open end of the bore 132 in the feed cylinder end cap 102.

Figure 10:
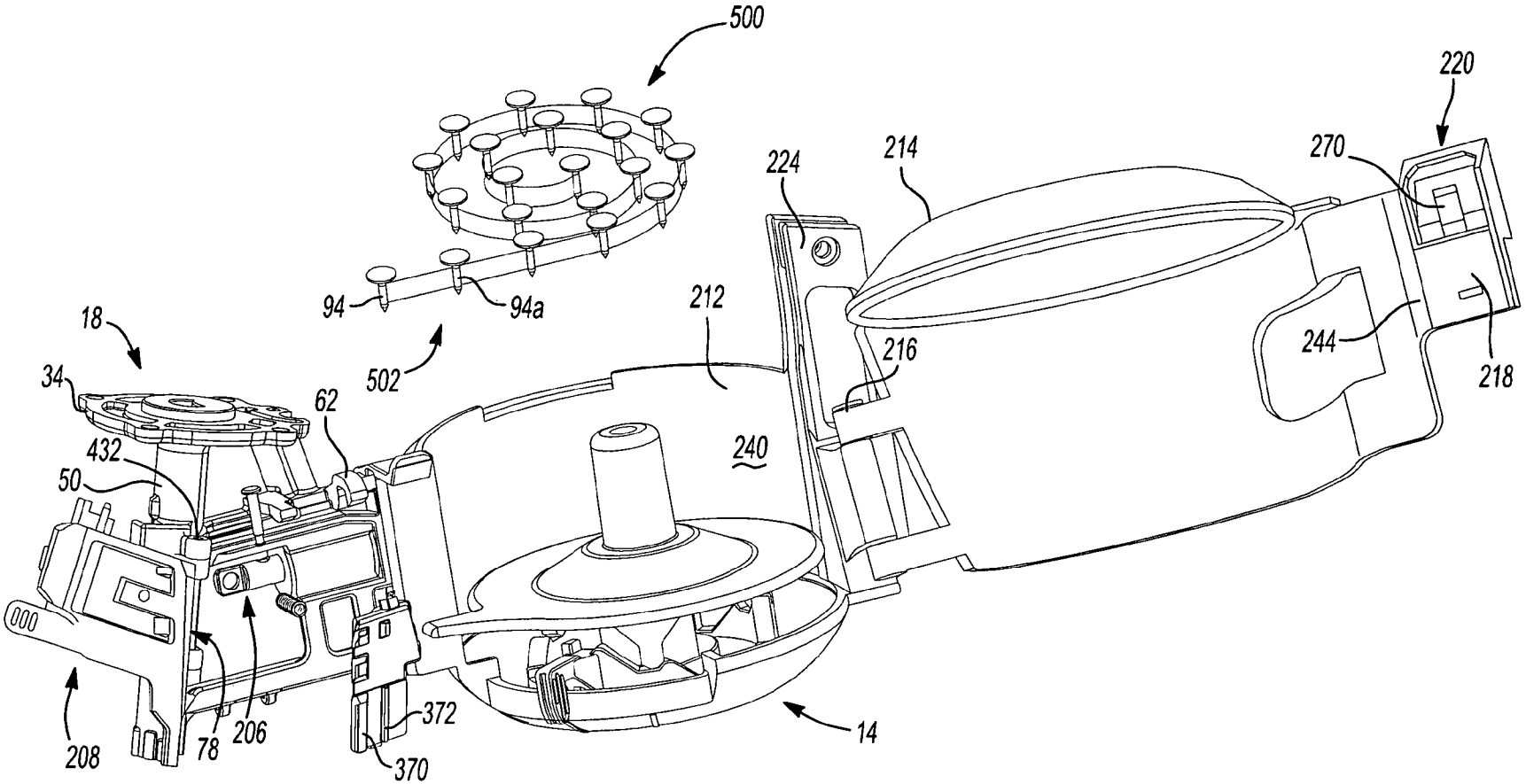
FIG. 10 is a perspective view of a portion of the fastening tool of FIG. 1 illustrating the nosepiece and magazine assembly in an open condition.

The second canister portion 214, which may be formed of an appropriate plastic material, may be pivotally coupled to the first canister portion 212 so that the second canister portion 214 may be moved between a first position, which may substantially close an interior portion of the canister 200, which is illustrated in FIG. 1, and a second position, which may generally clear the first canister portion 212 so that coiled, collated nails 500 may be loaded into the interior portion 240 of the canister 200 as illustrated in FIG. 10. The second canister portion 214 may include an ear 244, which extends toward the feed pawl assembly 206 and overlies a portion of the follower pawl assembly 208 when the fastening tool 10 is operated, and a latch mount 248.

Returning to FIG. 8, the latch bracket 218, which may be formed of a relatively high-strength and impact-resistant material such as steel, may be coupled to the ear 244 and may have a generally U-shaped portion 250, which may be configured to abut the opposite end faces 252 of the ear 244, and one or more hook portions 254.

The canister latch 220 may include a latch structure 260, a latch pivot pin 262 and a latch spring 264. The latch structure 260 may include a latch member 270, and a latch handle 272 and may be pivotally coupled to the latch mount 248 formed on the second canister portion 214 by the latch pivot pin 262. The latch pivot pin 262 may also be employed to couple or aid in coupling the latch bracket 218 to the second canister portion 214. In the example provided, the latch pivot pin 262 extends through the hook portions 254 to secure an end of the latch bracket 218 opposite the ear 244 to the latch mount 248. The latch spring 264 biases the latch structure 260 about the latch pivot pin 262 in a predetermined rotational direction.

The latch member 270 is configured to cooperate with the canister latch post 62 to releasably secure the second canister portion 214 in the closed position. In this regard, the canister latch post 62 is complementary to the latch member 270 so that when the second canister portion 214 is urged toward the closed position, the tapered latch contact 170 interacts with the latch member 270 to cause the latch member 270 to rotate in a rotational direction opposite the rotational direction in which it is biased by the latch spring 264. When a confronting surface 280 of the latch member 270 passes the abutting surface 172 of the canister latch post 62, the latch spring 264 urges the latch member 270 in a rotational direction so that the confronting surface 280 of the latch member 270 abuts the abutting surface 172 of the canister latch post 62. A user may pivot the latch handle 272 about the latch pivot pin 262 in the rotational direction opposite the rotational direction in which the latch structure 260 is biased by the latch spring 264 to position the confronting surface 280 of the latch member 270 into a position that clears the abutting surface 172 so that the second canister portion 214 may be moved from the closed position to the open position.

Figure 4:
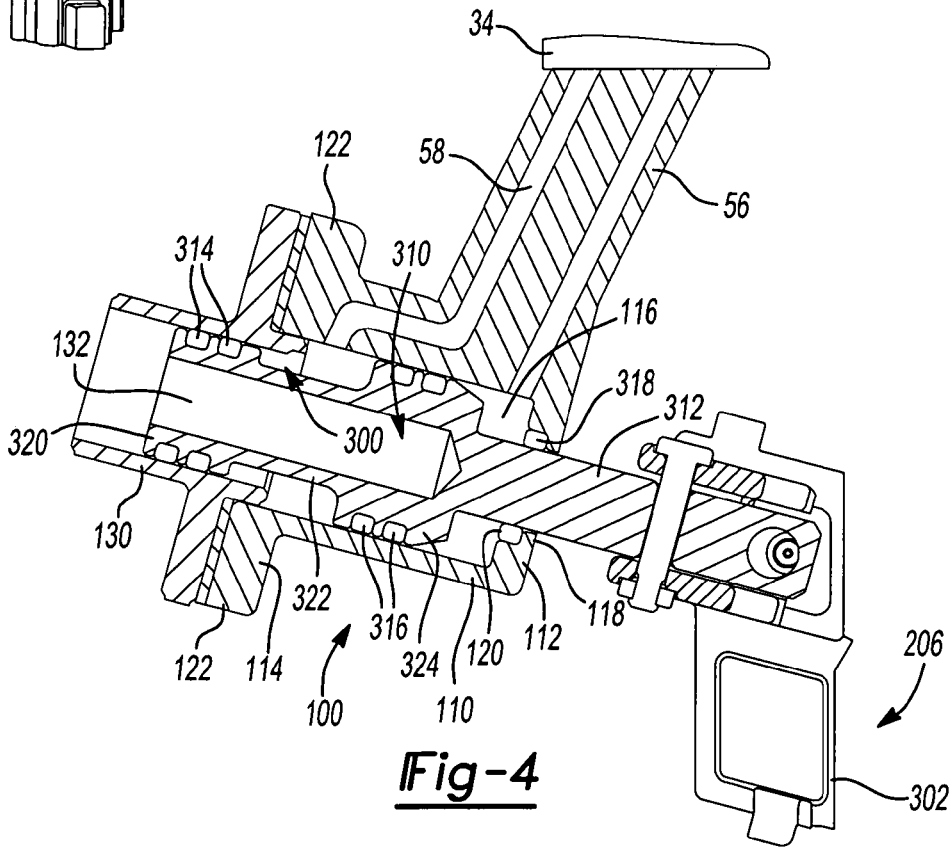
FIG. 4 is an exploded perspective view in partial section of a portion of the nosepiece and magazine assembly.
Figure 5:
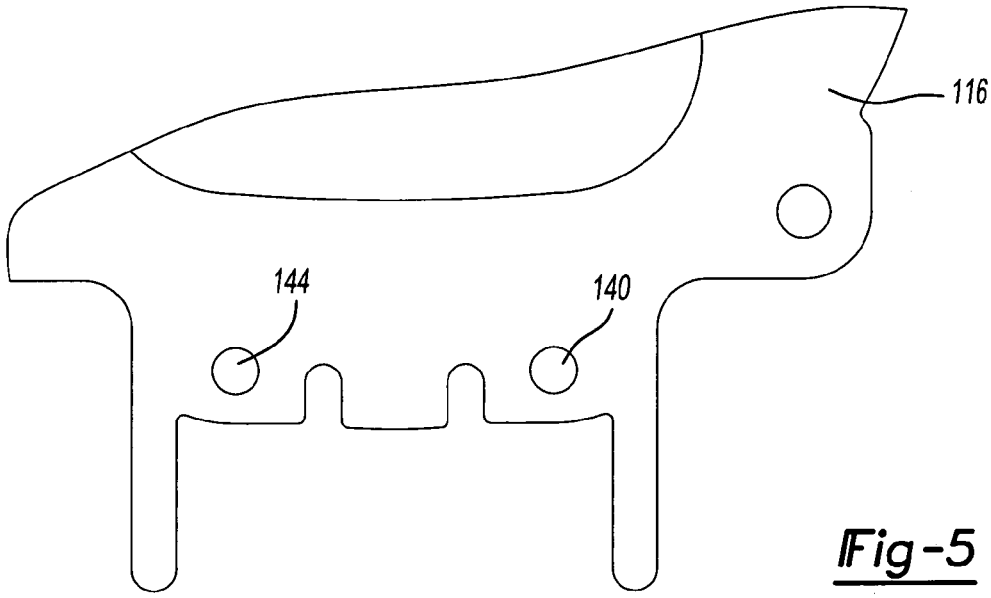
FIG. 5 is a sectional view taken through a portion of the fastening tool of FIG. 1.

In FIGS. 2 and 4, the feed pawl assembly 206 of the feed mechanism 202 may include a feed piston assembly 300, a feed pawl 302, a hinge pin 304 and a feeder biasing spring 306. The feed piston assembly 300 may include a feed piston 310, a feed rod 312, and first, second and third seals 314, 316 and 318, respectively. The feed piston 310 may include a first body portion 320, a necked-down portion 322, and a second body portion 324. The first body portion 320 may be formed of a first diameter and may include a pair of seal grooves 326 for receiving the first seals 314, which may be O-rings. The first body portion 320 may be slidably received in the bore 132 of the feed cylinder end cap 102. The necked-down portion 322 may be located between the first and second body portions 320 and 322 and may be smaller in diameter than the first body portion 320 and larger in diameter than the feed rod 312. The second body portion 324 may be disposed on a side of the necked-down portion 322 opposite the first body portion 320 and may include a pair of seal grooves 328 that are configured to receive the second seals 316, which may be O-rings. The second body portion 324 may be slidably received in the bore 116 in the feed cylinder structure 100.

The feed rod 312 may be coupled to the second body portion 324 and may include a flat 340, which may be formed onto an end of the feed rod 312 opposite the second body portion 324, and a pivot pin aperture 342 that may be formed through the feed rod 312 in a direction that may be generally parallel to the flat 340. A spring bore 344 may be formed into the feed rod 312 in an orientation that is generally perpendicular to both the flat 340 and the pivot pin aperture 342. The feed rod 312 may be received into the rod aperture 118 and extend through the first flange 112 of the feed cylinder structure 100. The third seal 318 may be disposed in the annular recess 120 that is formed in the first flange 112 and may sealingly engage both the first flange 112 of the feed cylinder structure 100 and a perimeter of the feed rod 312.

Figure 11:
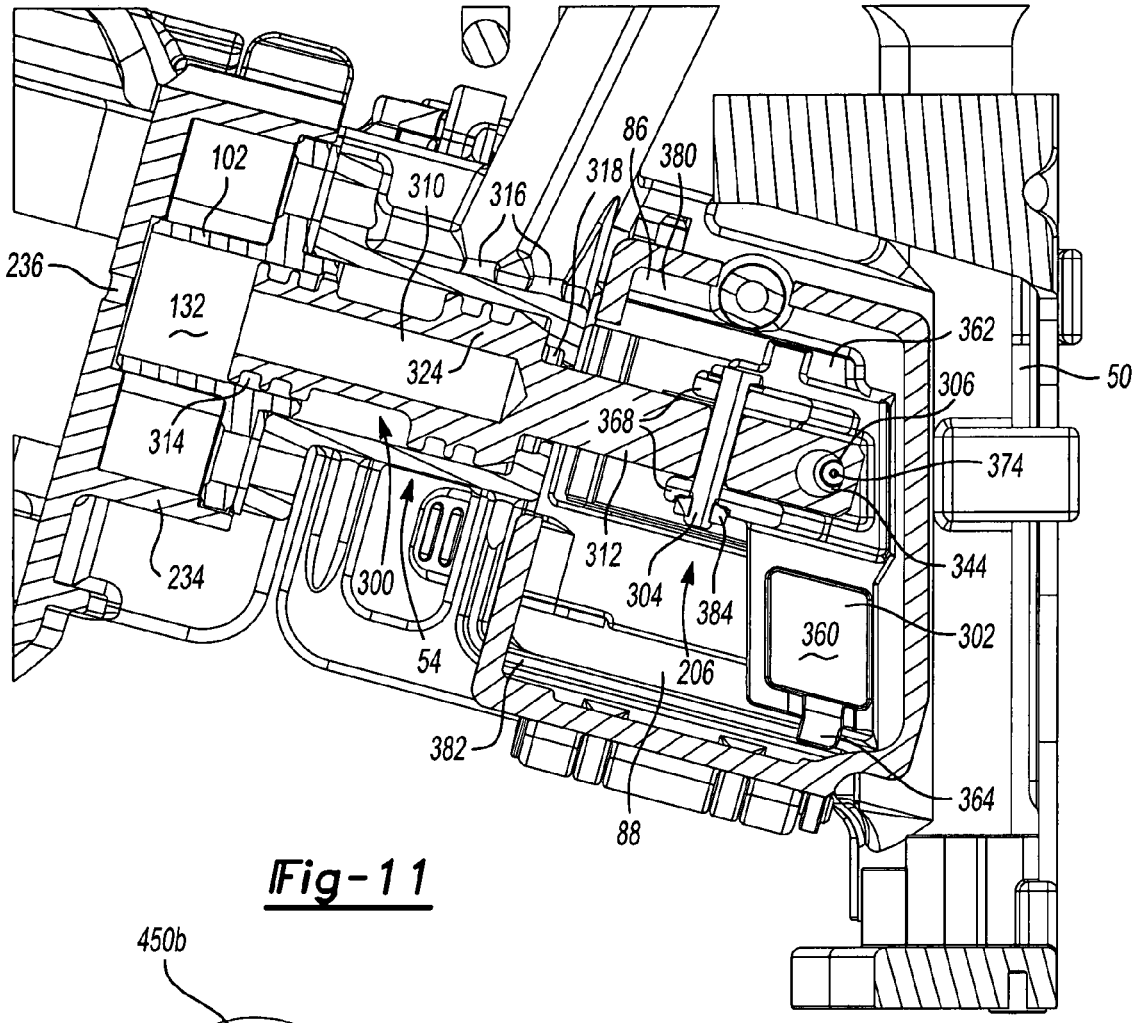
FIG. 11 is a sectional view taken through a portion of the magazine assembly and illustrating the feed cylinder, the feed piston assembly and the feed pawl assembly in greater detail.

With reference to FIGS. 2 and 11, the feed pawl 302 may include a backing plate 360, first and second guide tabs 362 and 364, respectively, and a pair of trunnion mounts 368. The backing plate 360 may include a primary feed tooth 370 and a secondary feed tooth 372, which may be formed on a first side of the backing plate 360, as well as a spring guide 374 on a second, opposite side. The primary and secondary feed teeth 370 and 372 may be spaced apart by a distance that permits one of the coiled, collated fasteners to be received therebetween. The first and second guide tabs 362 and 364 may extend laterally from the opposite lateral sides of the backing plate 360 and may be configured to engage first and second guide rails 380 and 382, respectively, that may be formed on a rear side of the first and second support legs 86 and 88, respectively. The trunnion mounts 368 may extend from a side of the backing plate 360 opposite the primary and secondary feed teeth 370 and 372 and may serve as a means for mounting the hinge pin 304 so that the feed pawl 302 may be pivotably coupled to the feed rod 312. More specifically, the feed rod 312 may be disposed between the trunnion mounts 368 such that a flat 340 that is formed on the feed rod 312 may generally face a rear side of the backing plate 360 and a pivot pin aperture 342 that is formed through the feed rod 312 may be aligned to a pin aperture 384 in the trunnion mounts 368. The hinge pin 304 may be disposed through pin apertures 384 and the pivot pin aperture 342 to thereby pivotally couple the feed pawl 302 to the feed piston assembly 300. The feeder biasing spring 306, which may be located in a blind spring bore 344 that is formed in the feed rod 312 and abut a rear face of the backing plate 360 where it is disposed over the spring guide 374, may bias the feed pawl 302 about the hinge pin 304 toward second body portion 324 of the feed piston assembly 300.

With the feed piston assembly 300 disposed in the feed cylinder 54 and the feed pawl 302 coupled to the feed rod 312 of the feed piston assembly 300 and supported by the first and second support legs 86 and 88, compressed air may be routed through the first and second feed cylinder conduits 56 and 58 to effect movement of the feed pawl 302 relative to the barrel 50. For example, compressed air may be routed through the first feed cylinder conduit 56 and directed to the bore 116 in the feed cylinder structure 100 at a location between the second and third seals 316 and 318, which may drive the feed piston assembly 300 (and the feed pawl 302) away from the barrel 50. Compressed air may also be routed through the second feed cylinder conduit 58 and directed to the bore 116 in the feed cylinder structure 100 at a location between the first and second seals 314 and 316, thereby driving the feed piston assembly 300 (and feed pawl 302) toward the barrel 50. The stroke of the feed piston assembly 300 may be slightly larger than a spacing between an adjacent pair of the collated fasteners (not shown).

Significantly, ambient air is not input directly into the feed cylinder 54 when the feed piston assembly 300 is reciprocated to feed the collated fasteners 94 into the barrel 50. Rather, the air that is input to the feed cylinder 54 (as well as the air that is exhausted from the feed cylinder 54) is routed through the housing assembly 12 (FIG. 1). Consequently, a feeding system constructed in accordance with the teachings of the present invention is much less susceptible to damage due to the entraining of dirt and debris into the air that is input to the feed cylinder 54.

We have found, too, that the use of a plurality of the first and second seals 314 and 316 on the feed piston 310 aids in both the retention of lubrication in the feed cylinder and the supporting and guiding of the feed piston 310 as it is reciprocated. The retaining of lubrication in the feed cylinder 54 greatly slows the rate at which the seals 314 and 316 wear. Moreover, improved support and guiding of the feed piston 310 reduces side-loading of the feed piston assembly 300 which not only reduces the overall wear rate of the seals 314, 316 and 318, the feed pawl 302 and the first and second guide rails 380 and 382, but also reduces or eliminates uneven wear on the seals 314, 316 and 318.

Returning to FIG. 2, the follower pawl assembly 208 may include a pair of trunnion mounts 400, a follower door 402, a follower structure 404, a follower pivot pin 406, a follower biasing spring 408, a pivot pin biasing spring 410 and a cover 412. The trunnion mounts 400 may be coupled to the follower door 402 and may cooperate with the trunnion mounts 84 of the nosepiece hinge mount 52 and a hinge pin 432 to provide a means by which the follower pawl assembly 208 may be pivotally but removably coupled to the nosepiece 18.

The follower door 402 may include a barrel portion 420, a frame structure 422, a stop member 424, a lifting tab 426 and a retaining tab 428. The barrel portion 420 may be configured to close a portion of the opening 78 in the barrel 50 when the follower pawl assembly 208 is positioned in a closed position. In the example provided, the lower contact trip 80 wraps about the barrel portion 420 when the contact trip 20 is urged upwardly into a position that activates the trigger or otherwise permits a user to activate the fastening tool 10 to install a fastener. The frame structure 422 may be coupled to the barrel portion 420 and/or the trunnion mounts 400 and may serve as a structure to which the follower structure 404, the follower pivot pin 406, the pivot pin biasing spring 410 and the cover 412 may be mounted.

The stop member 424 may extend from the frame structure 422 and may be configured to contact a complementary stop 430, which may be formed on the magazine latch post 60 for example, to inhibit the follower door 402 from pivoting about the hinge pin 432 into a position that may inhibit the feeding of collated fasteners into the barrel 50. The retaining tab 428 and the lifting tab 426, which may be engaged by the finger or thumb of an operator when the follower pawl assembly 208 is to be pivoted about the hinge pin 432, may also be coupled to frame structure 422. As will be described in more detail below, the retaining tab 428 may be configured to cooperate with the canister 200 to inhibit the follower pawl assembly 208 from being moved from the closed position to the open position and from the open position to the closed position when the second canister portion 214 is in the closed position.

Figure 12:
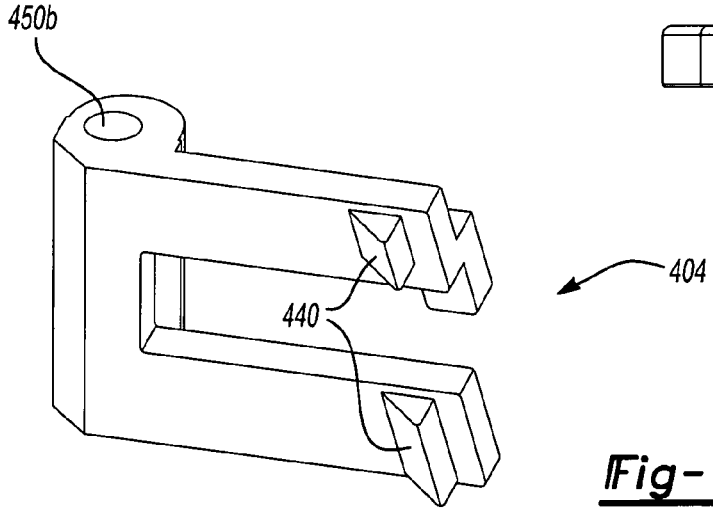
FIG. 12 is a perspective view of a portion of the magazine assembly illustrating the follower structure in greater detail.

With additional reference to FIG. 12, the follower structure 404, which may be generally U-shaped, may be pivotally coupled to the frame structure 422 by the follower pivot pin 406. The follower structure 404 may include a plurality of stop tooth 440 and a stop member 442 that may be configured to contact the frame structure 422 to limit the amount by which the follower structure 404 may rotate outwardly from the frame structure 422 toward the feed pawl 302. The follower teeth may be configured to engage the collated fasteners (not shown) on a side opposite the feed pawl 302.

The follower biasing spring 408 may be disposed between the follower structure 404 and the cover 412, which may be removably coupled to the frame structure 422 via a threaded fastener 444. The follower biasing spring 408 may be configured to bias the follower structure 404 in a direction towards the feed pawl 302 when the follower pawl assembly 208 is positioned in the closed position.

The follower pivot pin 406 be configured to be received through apertures 450*a* and 450*b* that are formed in the frame structure 422 and the follower structure 404, respectively, and may include a head portion 460, a body portion 462 and an end portion 464. The head portion 460 may include a spring follower 466 and an abutting portion 468 which may be generally larger in size than the spring follower 466 or the body portion 462. The end portion 464 may be coupled to an end of the body portion 462 opposite the head portion 460 and may be a tapered or rounded shape.

With additional reference to FIG. 7, the pivot pin biasing spring 410 may be disposed about the spring follower 466 and abut both the head portion 460 and an L-shaped portion 470 of the cover 412. The pivot pin biasing spring 410 may exert a force onto the follower pivot pin 406 that urges the end portion 464 outwardly of the frame structure 422 so that it may serve as a detent that may cooperate with the magazine latch post 60 to retain the follower pawl assembly 208 in the closed position.

When the follower pawl assembly 208 is moved from the open position to the closed position (or from the closed position to the open position), the end portion 464 may cooperate with the magazine latch post 60 to shift the follower pivot pin 406 relative to the frame structure 422. More specifically, contact between the end portion 464 of the follower pivot pin 406 and the first ramp 160 as the follower pawl assembly 208 is being moved to the closed position (or with the second ramp 162 as the follower pawl assembly 208 is being moved to the open position) urges the follower pivot pin 406 into the frame structure 422. The force that is exerted by the pivot pin biasing spring 410 urges the follower pivot pin 406 outwardly so that contact between the follower pivot pin 406 and the magazine latch post 60 tends to maintain the follower pawl assembly 208 in the closed position.

With reference to FIGS. 2, 4 and 10, the magazine assembly 14 may be opened to load collated fasteners into the magazine assembly 14. In this regard, the canister latch 220 may be actuated so as to retract the latch member 270 from the canister latch post 62, the second canister portion 214 may be rotated about the hinge pin 216 to expose an interior portion of the canister 200, and the follower pawl assembly 208 may be rotated about the hinge pin 432 to the open position which substantially clears the follower pawl assembly 208 and the opening 78 in the barrel 50. A coil 500 of the collated fasteners 94 may be inserted into the canister 200 and an outer end 502 of the collated fasteners 94 may be strung towards the barrel 50 such that one of the collated fasteners 94 is disposed between the primary and secondary feed teeth 370 and 372. The follower pawl assembly 208 may be returned to the closed position and thereafter the second canister portion 214 may be closed so as to re-engage the canister latch 220 to the canister latch post 62.

Figure 6:
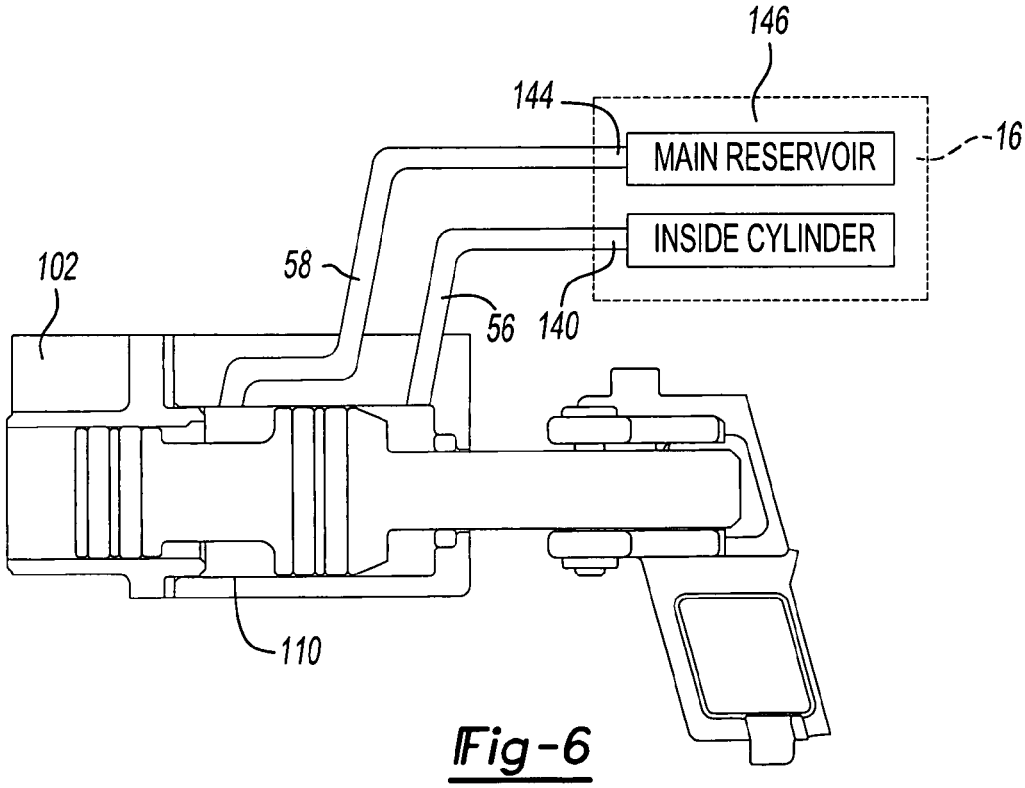
FIG. 6 is a schematic illustration of a portion of the fastening tool of FIG. 1 illustrating a pneumatic circuit for translating the feed piston assembly.

With additional reference to FIGS. 1 and 6, when a source of compressed air 510 is coupled to the fastening tool 10, compressed air may be directed through the second feed channel 144 in the housing 16 and into the second feed cylinder conduit 58 where it is directed against the feed piston 310 in such a way that the feed pawl 302 is maintained in an extended position that is proximate the barrel 50. When the trigger 22 is depressed and the trigger valve 148 is actuated, the piston 142 is translated within the motor 24, thereby translating the driver 26 so that the driver 26 may impact and drive a fastener 94 located in the barrel 50 into a workpiece (not shown). When the piston 142 is translated to a drive position prior to the driving of the fastener 94, air within the motor 24 may be exhausted through the first feed channel 140 in the housing 16 and into the first feed cylinder conduit 56 where it may be directed against the feed piston 310 in such a way as to cause the feed pawl 302 to translate toward the feed cylinder 54.

The follower structure 404 may be biased toward the fastener 94 that is located between the primary and secondary feed teeth 370 and 372 and as such, the stop tooth 440 (FIG. 12) on the follower structure 404 may engage one of the fasteners 94 in the outer end 502, such as the fastener 94 that is located between primary and secondary feed teeth 370 and 372, to thereby inhibit movement of the fasteners 94 in the outer end 502 toward the canister 200 when the feed pawl 302 is translated toward the feed cylinder 54. The shape of the primary and secondary feed teeth 370 and 372 permits the feed pawl 302 to rotate about the hinge pin 304 in a direction away from the fasteners 94 so that the primary and secondary feed teeth 370 and 372 may skip over one set of adjacent fasteners 94. Thereafter, the feeder biasing spring 306 urges feed pawl 302 outwardly toward the fasteners 94 so that a next fastener 94*a* is disposed between the primary and secondary feed teeth 370 and 372.

When the pressure of the air that is exhausted from the motor 24 in response to the returning of the piston 142 has subsided, the pressure of the air that is delivered through the second feed cylinder conduit 58 is sufficient to cause the feed piston assembly 300 to translate in a direction that returns the feed pawl 302 to a position proximate the barrel 50. The primary feed tooth 370 (and to a somewhat lesser extent, the secondary feed tooth 372) pushes the outer end 502 of the fasteners 94 toward the barrel 50. The follower biasing spring 408 permits the follower structure 404 to pivot about the follower pivot pin 406 so that the stop tooth 440 skip over the fastener 94 as the outer end 502 of the fasteners 94 is indexed toward the barrel 50.

Figure 13:
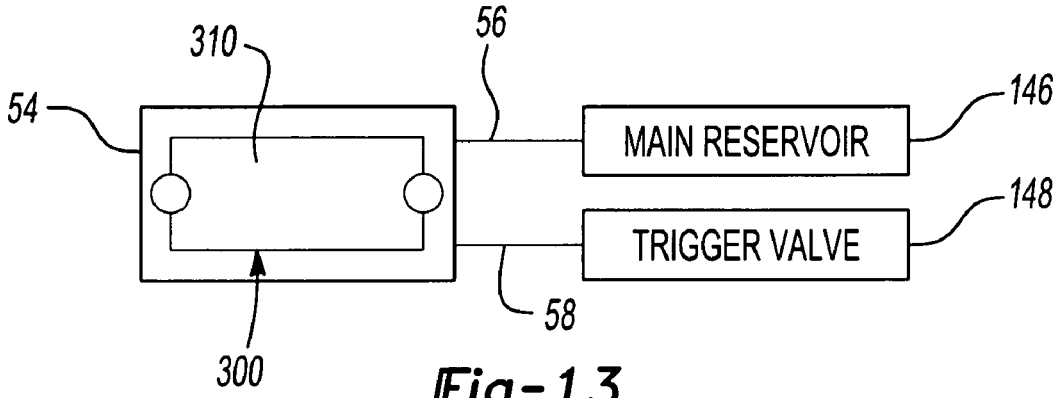
FIG. 13 is a schematic illustration of an alternately constructed fastening tool illustrating another pneumatic circuit for translating the feed piston assembly.

While the fastening tool has been described thus far as including a double-acting feed cylinder that is fed from both a main drive reservoir (i.e., line air pressure) and the exhaust of the motor, those skilled in the art will appreciate that the invention, in its broader aspects, may be constructed somewhat differently. For example, the first feed cylinder conduit 56 may be coupled to the main drive reservoir 146 to continuously apply line air pressure to a first side of the feed piston 310 and the second feed cylinder conduit 58 may be coupled to the trigger valve 148 as is illustrated in FIG. 13. In this embodiment, the feed piston assembly 300 is normally maintained in a position proximate the barrel 50 and translates toward the feed cylinder 54 after the trigger valve 148 has been actuated.

Figure 14:
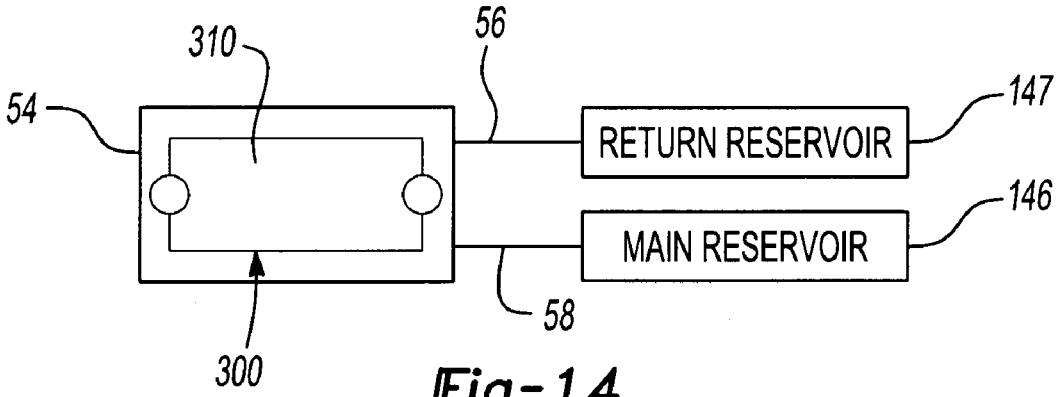
FIGS. 14 and 15 are schematic illustrations similar to that of FIG. 13 but illustrating two additional pneumatics circuit for translating the feed piston assembly.
Figure 15:
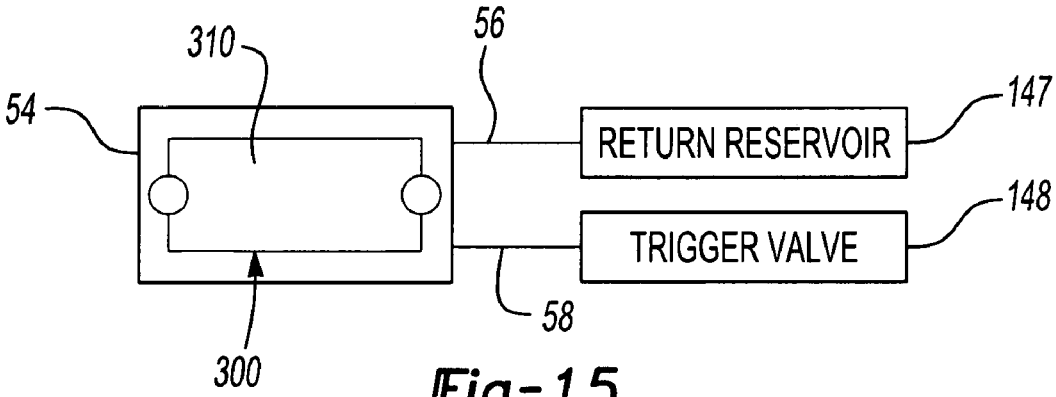

As another example, the first feed cylinder conduit 56 may be coupled to a return reservoir 147 (i.e., a reservoir that is employed to store compressed air that is to be used to return the piston 142 after a fastener has been driven into a workpiece) and the second feed cylinder conduit 58 may be coupled to either the main drive reservoir 146 (FIG. 14) or to the trigger valve 148 (FIG. 15).

Figure 16:
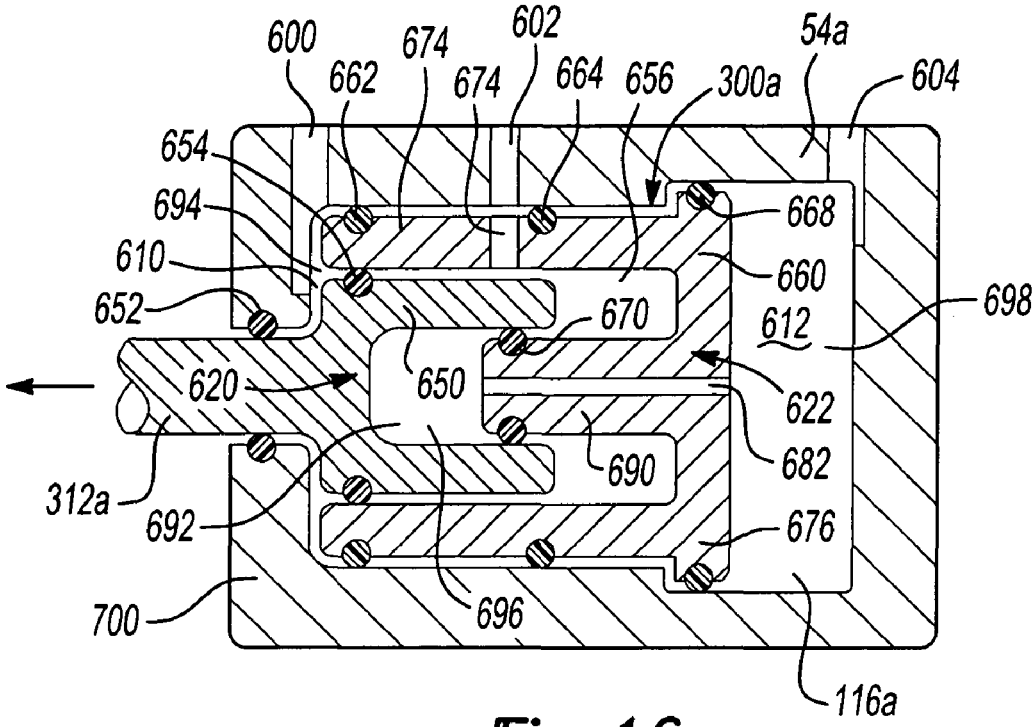
FIG. 16 is a longitudinal cross-section of a double-acting double cylinder for translating the feed pawl.

In the example of FIG. 16, the feed cylinder 54*a* may include a bore 116*a*, a first port 600, a second port 602, and a third port 604. The bore 116*a* may include a first bore portion 610 and a second bore portion 612 that may be relatively larger in cross-sectional area than the first bore portion 610. The first port 600 may intersect the first bore portion 610 at a first end of the feed cylinder 54*a*, the second port 602 may intersect the first bore portion 610 at an intermediate location, and the third port may intersect the second bore portion 612 at a second end of the feed cylinder 54*a* opposite the first end.

The feed piston assembly 300*a* may include a primary feed piston assembly 620 and a secondary feed piston assembly 622. The primary feed piston assembly 620 may include the feed rod 312*a*, a primary feed piston 650, a first seal 652 and a second seal 654. The first seal 652 may sealingly engage the feed rod 312*a* and the feed cylinder 54*a*, while the second seal 654 may be carried by the primary feed piston 650 and may sealingly engage the primary feed piston 650 and the perimeter of a first interior cavity 656 formed in the secondary feed piston 660.

The secondary feed piston assembly 622 includes a secondary feed piston 660, a third seal 662, a fourth seal 664, a fifth seal 668 and a sixth seal 670. The secondary feed piston 660 may include a body portion 674 and an end portion 676. A first vent channel 680 may be formed through the body portion 674 generally transverse thereto and a second vent channel 682 may be formed through the end portion 676 in a direction that is generally parallel to a longitudinal axis of the secondary feed piston 660. The third seal 662 may be carried by the body portion 674 and may be configured to form a seal between a the secondary feed piston 660 and the feed cylinder 54*a* at a location between the first and second ports 600 and 602. The fourth seal 664 may be carried by the secondary feed piston 660 and may form a seal between the body portion 674 and the feed cylinder 54*a* at a location along the first bore portion 610 between the second and third ports 602 and 604. The fifth seal 668 may be carried by the secondary feed piston 660 and may form a seal between the end portion 676 and the feed cylinder 54*a* at a location along the second bore portion 612 between the second and third ports 602 and 604. The sixth seal 670 may be carried by the secondary feed piston 660 and may sealingly engage a projection 690, which extends from the end portion 676, and the perimeter of a second interior cavity 692 formed in the primary feed piston 650. Configuration of the primary and secondary feed pistons 650 and 660 in this manner defines three distinct cavities 694, 696 and 698.

In operation, each of the first, second and third ports 600, 602 and 604 may be exposed to a supply of pressurized fluid (e.g., compressed air) so that the pressure in one of the ports may be substantially equal to the pressure in the other ports. As the end portion 676 of the secondary feed piston 660 is relatively larger in cross-sectional area than the body portion 674, fluid pressure drives the secondary feed piston 660 toward the first end 700 of the feed cylinder 54*a*. Likewise, as fluid pressure is applied via the second and third ports 602 and 604 over a cross-sectional area that is relatively larger than the area over which fluid pressure is applied via the first port 600, the primary feed piston 650 is also urged toward the first end 700 of the feed cylinder 54*a*.

When a fastener is to be indexed into the barrel, the pressure of the fluid that is supplied via the second port 602 is reduced (e.g., the second port 602 may be vented to the atmosphere) by an amount that is sufficient to permit the pressure of the fluid that is provided by the first port 600 to urge the primary feed piston 650 away from the first end 700 of the feed cylinder 54 to thereby move the feed pawl over a next one of the collated fasteners. Contact between the primary feed piston 650 and the projection 690 that is formed on the secondary feed piston 660 may limit movement of the primary feed piston 650 in a direction away from the first end 700 of the feed cylinder 54*a*. Thereafter, the pressure of the fluid that is supplied via the second port 602 may be increased (e.g., to a pressure that is equal to the pressure of the fluid in the other ports) to cause the primary feed piston 650 to translate toward the first end of the feed cylinder 54*a*.

When the second canister portion is opened, as when a new coil of collated fasteners are to be introduced to the drum, the pressure of the fluid that is supplied via the second and third ports 602 and 604 may be reduced (e.g., the second and third ports 602 and 604 may be vented to the atmosphere) by an amount that is sufficient to permit the pressure of the fluid that is provided by the first port 600 to urge the secondary feed piston 660 away from the first end 700 of the feed cylinder 54*a*. As the secondary feed piston 660 translates away from the first end 700 of the feed cylinder 54*a* (thereby positioning the projection 690 relatively further away from the first end 700 of the feed cylinder 54*a*), the primary feed piston 650 is translated relatively further away from the first end 700 of the feed cylinder 54*a*. The additional length in the stroke of the primary feed piston 650 that is obtained by shuttling the secondary feed piston 660 may be employed to improve the speed with which an initial one of the collated fasteners is loaded into the barrel and/or to render the process of loading collated fasteners into the nosepiece easier for an operator.

Figure 17:
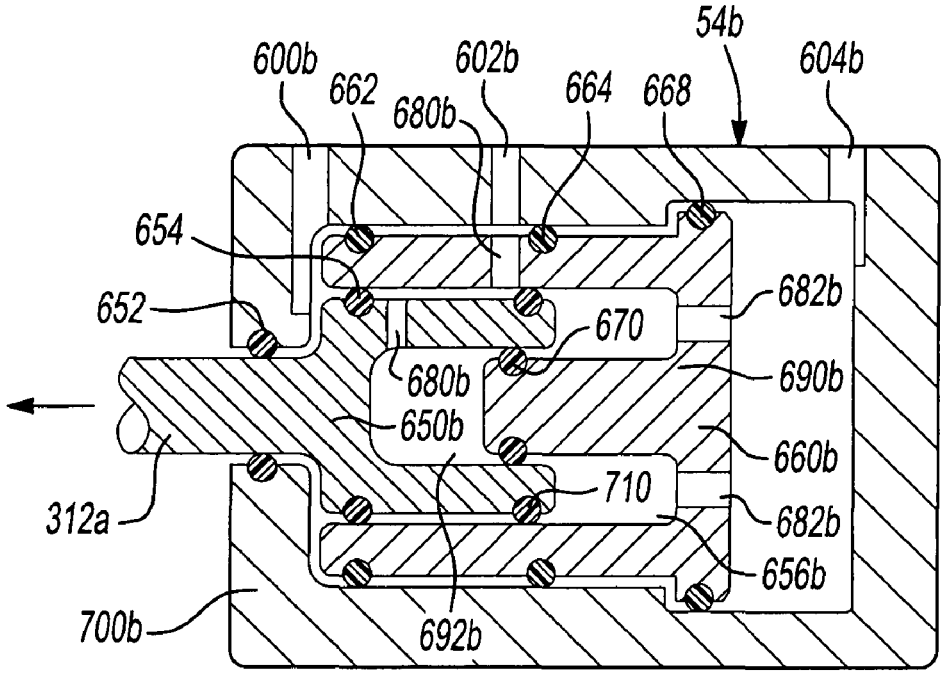
FIGS. 17 through 20 are alternately constructed double-acting double cylinders for translating the feed pawl.

The example of FIG. 17 is somewhat similar to that which is illustrated in FIG. 16, except that the first vent channel 680*b* extends through the primary feed piston 650*b* into the second interior cavity 692*b*, the second vent channels 682*b* do not extend through the projection 690*b* but rather are disposed radially outward there from, and a seventh seal 710, which may be carried by the primary feed piston 650*b*, may be employed to form a seal between the primary feed piston 650*b* and the perimeter of the first interior cavity 656*b* that is formed in the secondary feed piston 660*b*.

During operation, the first and second ports 600*b* and 602*b* may be vented in an appropriate manner (e.g., to the atmosphere) and pressurized fluid may be transmitted through the third port 604*b* to drive both the primary and secondary feed pistons 650*b* and 660*b* toward the first end 700*b* of the feed cylinder 54*b*. When a fastener is to be fed into the nosepiece, a fluid, which may have a pressure that is about equal to the pressure of the fluid that is supplied through the third port 604*b*, may be transmitted through the first port 600*b* to drive the primary feed piston 650*b* away from the first end 700*b* of the feed cylinder 54*b* to thereby index the feed pawl into engagement with a next one of the collated fasteners. Thereafter, the first port 600*b* may be vented to permit the fluid that is delivered through the third port 604*b* to shuttle the primary feed piston 650*b* toward the first end 700*b* of the feed cylinder 54*b*. When the second canister portion is opened, fluid under pressure may be provided through the first port 600*b*, while both the second and third ports 602*b* and 604*b* are vented to thereby cause both the primary and secondary feed pistons 650*b* and 660*b* to translate away from the first end 700*b* of the feed cylinder 54*b*.

Figure 18:
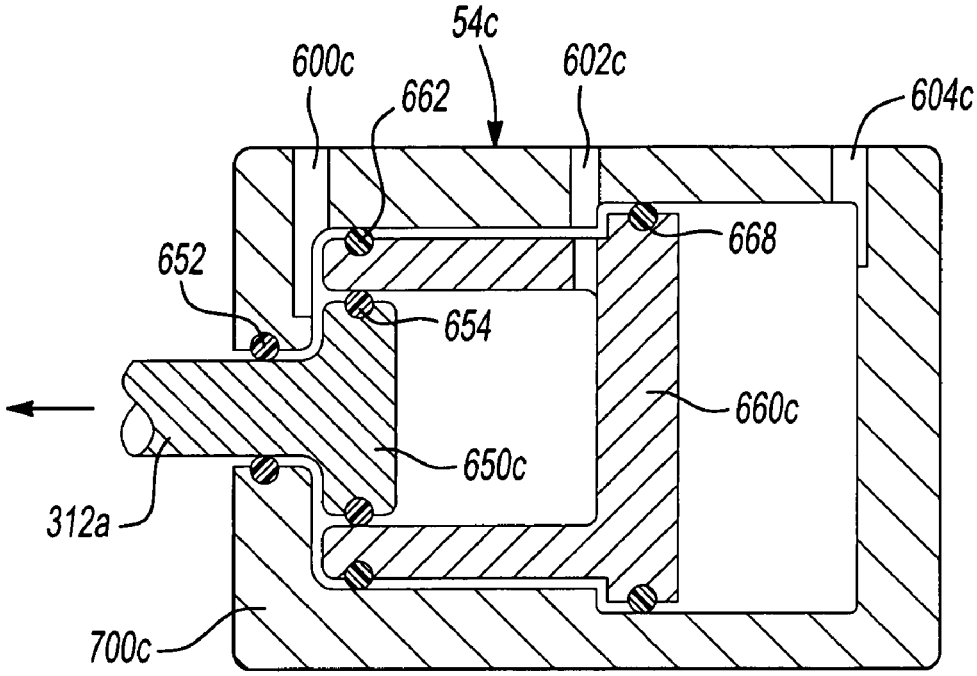

In the example of FIG. 18 is also similar to that which is illustrated in FIG. 16, except that the primary feed piston 650*c* lacks an internal cavity, the secondary feed piston 660*c* lacks a projection, and the fourth and sixth seals are omitted. During operation, fluid under pressure may be supplied through the first, second and third ports 600*c*, 602*c* and 604*c*, which drives both the primary feed cylinder 54*c* and the secondary feed piston 660*c* toward the first end 700*c* of the feed cylinder 54*c*. When a fastener is to be fed into the nosepiece, fluid pressure in the second port 602*c* may be vented in an appropriate manner (e.g., to the atmosphere), which permits the fluid that is delivered through the first port 600*c* to translate the primary feed piston 650*c* away from the first end 700*c* of the feed cylinder 54*c* to thereby index the feed pawl into engagement with a next one of the collated fasteners. Thereafter, the pressurized fluid may be communicated through the second port 602*c* to shuttle the primary feed piston 650*c* toward the first end 700*c* of the feed cylinder 54*c*. When the second canister portion is opened, both the second and third ports 602*c* and 604*c* may be vented while fluid under pressure is applied via the first port 600*c* to the primary and secondary feed pistons 650*c* and 660*c* to thereby cause both the primary and secondary feed pistons 650*c* and 660*c* to translate away from the first end 700*c* of the feed cylinder 54*c*.

Figure 19:
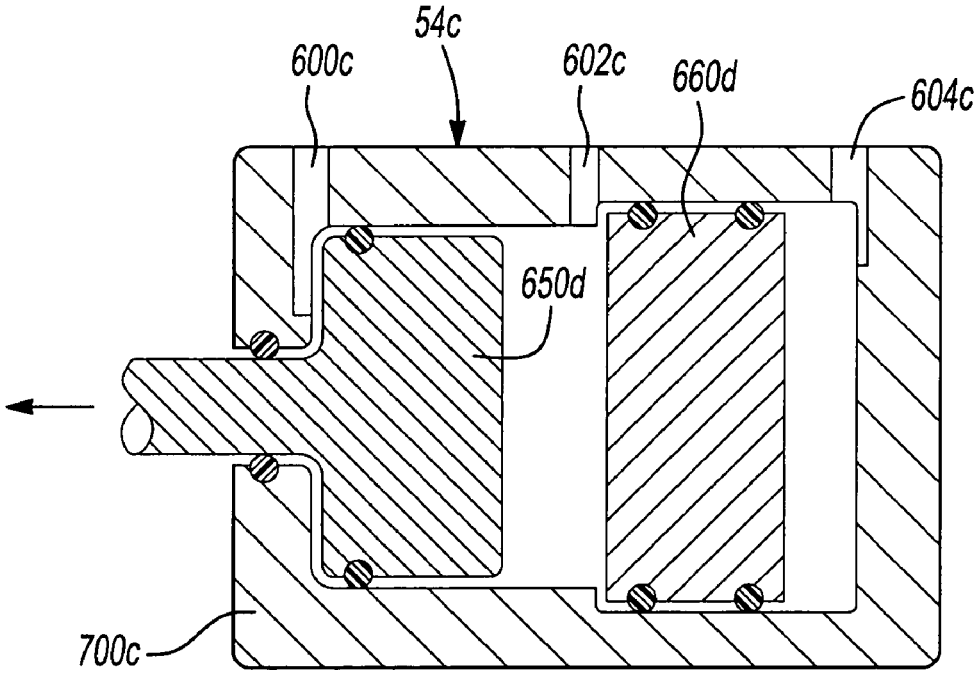

The embodiment of FIG. 19 is substantially similar to that which is illustrated in FIG. 18 and described in the immediately preceding paragraph, except that the primary and secondary feed pistons 650*d* and 660*d* are discrete pistons that are not sealingly engaged to one another.

Figure 20:
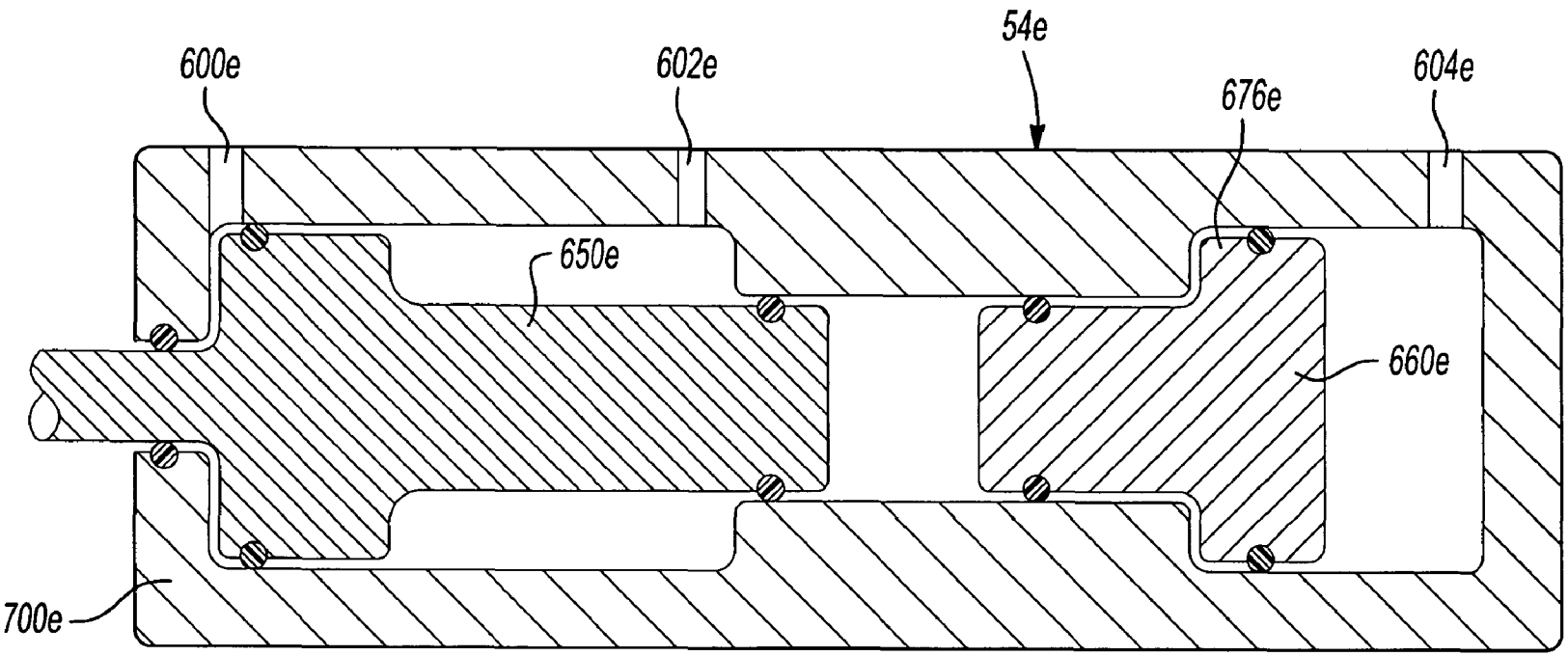

The example of FIG. 20 also employs primary and secondary feed pistons 650*e* and 660*e* that are discrete and which do not sealingly engage one another. In this example, the first port 600*e* may be vented in an appropriate manner, while a pressurized fluid may be delivered via the second and third ports 602*e* and 604*e*. The application of fluid pressure to the second port 602*e* causes the primary feed piston 650*e* to be maintained in a position adjacent the first end 700*e* of the feed cylinder 54*e*, while the application of fluid pressure to the third port 604*e* causes the secondary feed piston 660*e* to be translated forwardly to a point where the end portion 676*e* contacts the feed cylinder 54*e*. When a fastener is to be fed into the nosepiece, fluid pressure may be applied to the primary feed piston 650*e* via the first port 600*e*, which causes the primary feed piston 650*e* to translate away from the first end 700*e* of the feed cylinder 54*e* and thereby index the feed pawl into engagement with a next one of the collated fasteners. Thereafter, the first port 600*e* may be vented so that the pressurized fluid that is introduced to the feed cylinder 54*e* via the second port 602*e* may translate the primary feed cylinder 54*e* to the position proximate the first end 700*e* of the feed cylinder 54*e*. When the second canister portion is opened, the third port 604*e* may be vented while fluid under pressure is applied via the first and second ports 600*e* and 602*e* to thereby cause both the primary and secondary feed pistons 650*e* and 660*e* to translate away from the first end 700*e* of the feed cylinder 54*e*.

Figure 21A:
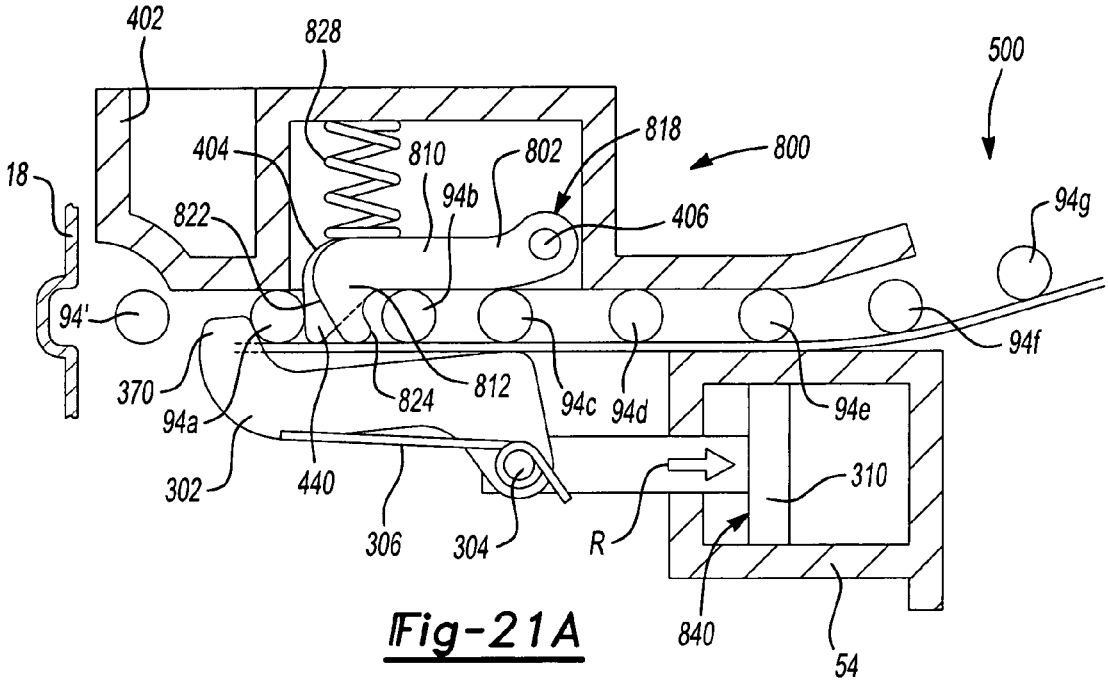
FIGS. 21A-21G, illustrate a feeder pawl assembly constructed in accordance to the present invention.
Figure 21B:
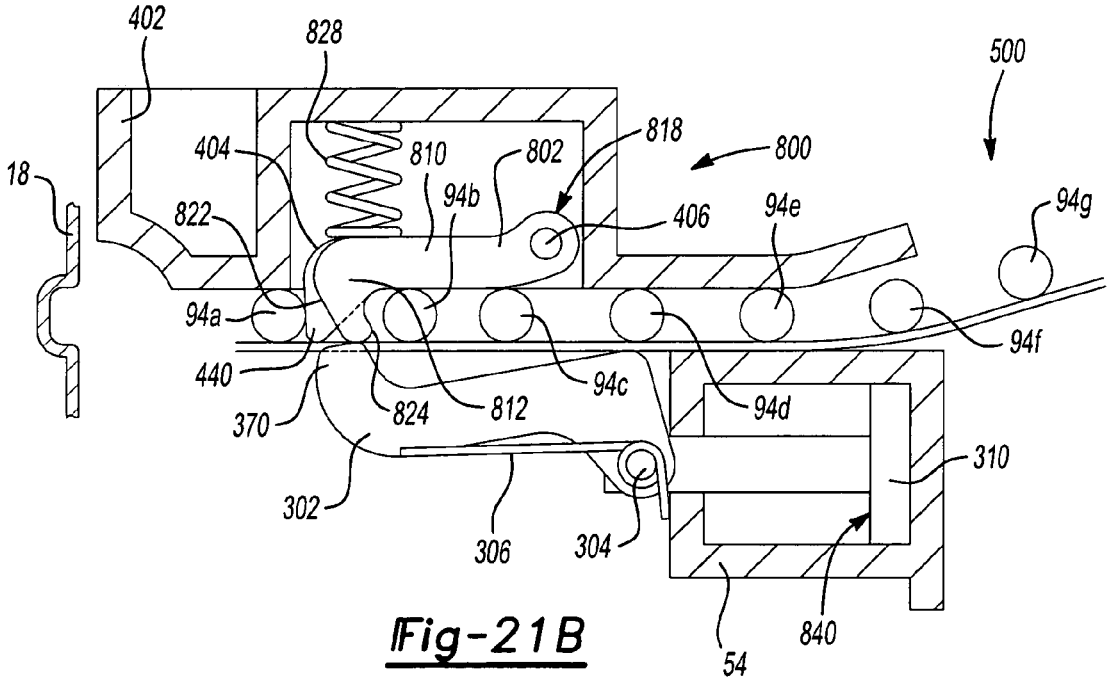
Figure 21C:
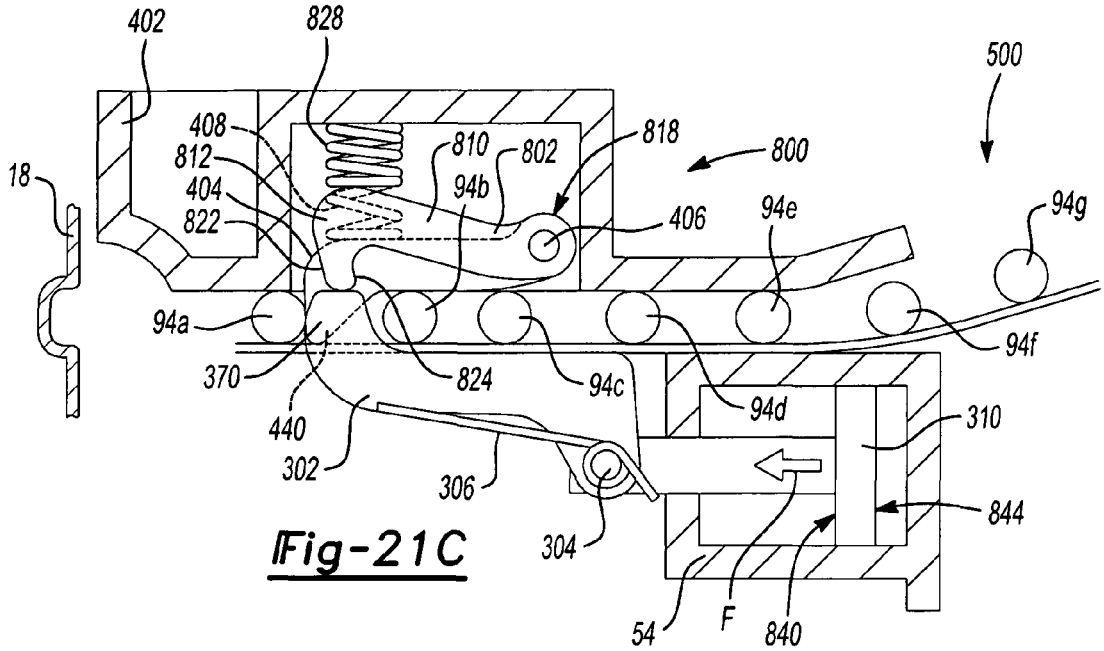

Turning now to FIGS. 21A-21G, a feeder pawl assembly constructed in accordance to the present invention is shown and generally identified at reference 800. The feeder pawl assembly 800 may include the feed pawl 302, the follower structure 404 and a spreader pawl 802. The feed pawl 302 may include the primary feed tooth 370. The primary feed tooth 370 may define a feed tooth width W for locating between adjacent fasteners 94 (see e.g., FIG. 21F). The follower structure 404 may include the stop tooth 440. The feed pawl 302 may be rotatably biased about the hinge pin 304 in a generally clockwise direction as viewed in FIGS. 21A-21G by the feeder biasing spring 306. The follower structure 404 and hence the stop tooth 440 may be rotatably biased in a generally counterclockwise direction about the follower pivot pin 406 by the follower biasing spring 408 (FIG. 21C).

The spreader pawl 802 may include a body portion 810 having a spreader tooth 812 disposed on a first end and a pivot joint 818 arranged on a second end. The spreader tooth 812 may generally define a leading surface 822 and a trailing surface 824. The trailing surface 824 may define a generally concave contour for grasping a leading edge of a fastener 94. The spreader pawl 802 may be rotatably biased in a generally counterclockwise direction about the follower pivot pin 406 at the pivot joint 818 by a spreader biasing spring 828. The follower biasing spring 408 may be disposed between the follower door 402 and the follower structure 404 (FIG. 21C). Similarly, the spreader biasing spring 828 may be disposed between the follower door 402 and the spreader pawl 802. As will become appreciated from the following discussion, the spreader pawl 802 can be adapted to spread adjacent fasteners 94 of the coil of fasteners 500 a predetermined distance to resist jamming of the fastening tool 10 as the fasteners 94 are sequentially fed into the nosepiece 18 during operation.

FIGS. 21A-21G depict operation of the feeder pawl assembly 800 through an exemplary feed sequence. In FIG. 21A, the feeder pawl assembly 800 is shown just after a fastener 94' has been fired. In FIG. 21A, pressure may be applied at a rebound surface 840 of the feed piston 310 in the feed cylinder 54 causing the feed piston 310 and hence the feed pawl 302 to actuate in a retract direction R. During movement of the feed pawl 302 in the retract direction R, the contour of the primary feed tooth 370 urges the feed pawl 302 to rotate in a counterclockwise direction about the hinge pin 304 upon contact with a leading edge of the fastener 94*a* (from FIG. 21A to FIG. 21B). Concurrently, the contour of the stop tooth 440 may urge against a trailing edge of the fastener 94*a* to preclude the feed pawl 302 from pulling the fastener 94*a* in the retract direction R. The contour of the stop tooth 440 and the biasing force of the follower biasing spring 408 may cooperate to maintain the stop tooth 440 in a static position (from FIG. 21A to FIG. 21B). In FIG. 21B, the feed piston 310 is shown fully retracted in the feed cylinder 54.

As depicted in FIGS. 21B-21C, the feed pawl 302 is shown engaging the spreader tooth 812 of the spreader pawl 802 and deflecting it generally upward (or, more specifically, in a generally clockwise direction about the follower pivot pin 406). The feeder biasing spring 306 and the feed pawl 302 may cooperate to provide a force suitable to overcome the bias of the spreader pawl 802 and the spreader biasing spring 828. It is noted, that the stop tooth 440 and the spreader pawl 802 may be arranged in an offset relationship whereby the feed pawl 302 aligns to make contact with the spreader pawl 802 without engaging the stop tooth 440 of the follower structure 404 (as best illustrated in FIG. 21C). In FIG. 21C, the feed pawl 302 is shown engaging the trailing edge of the fastener 94*a*.

Figure 21D:
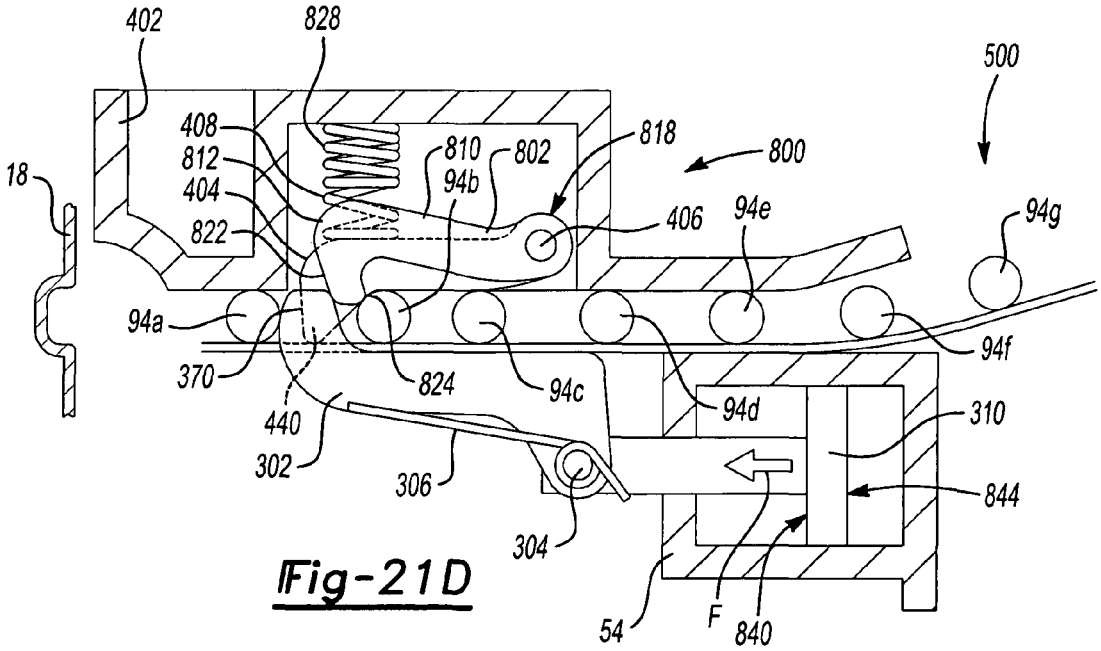
Figure 21E:
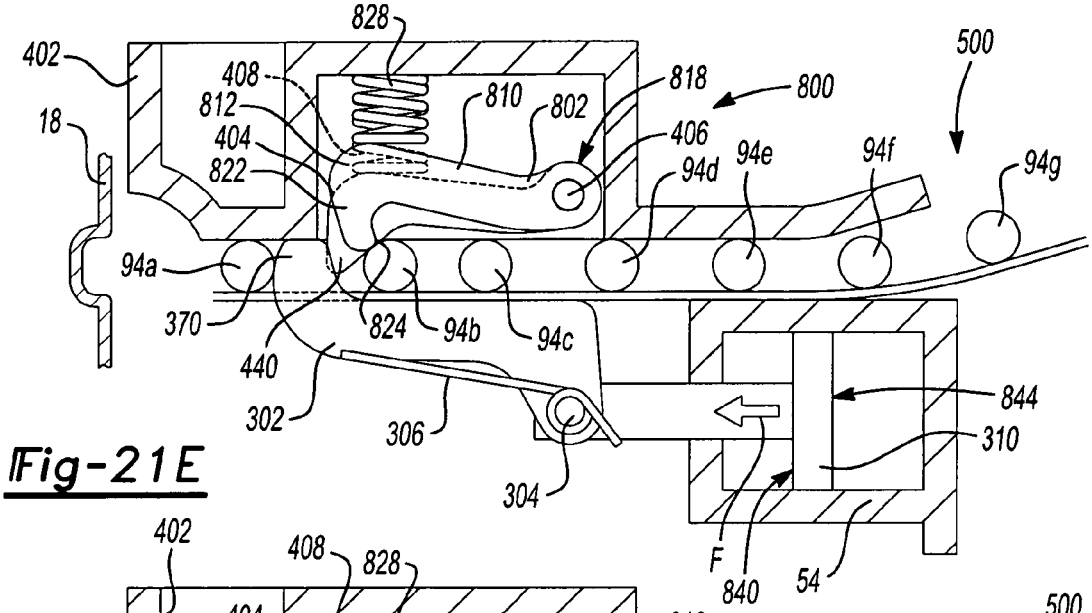
Figure 21F:
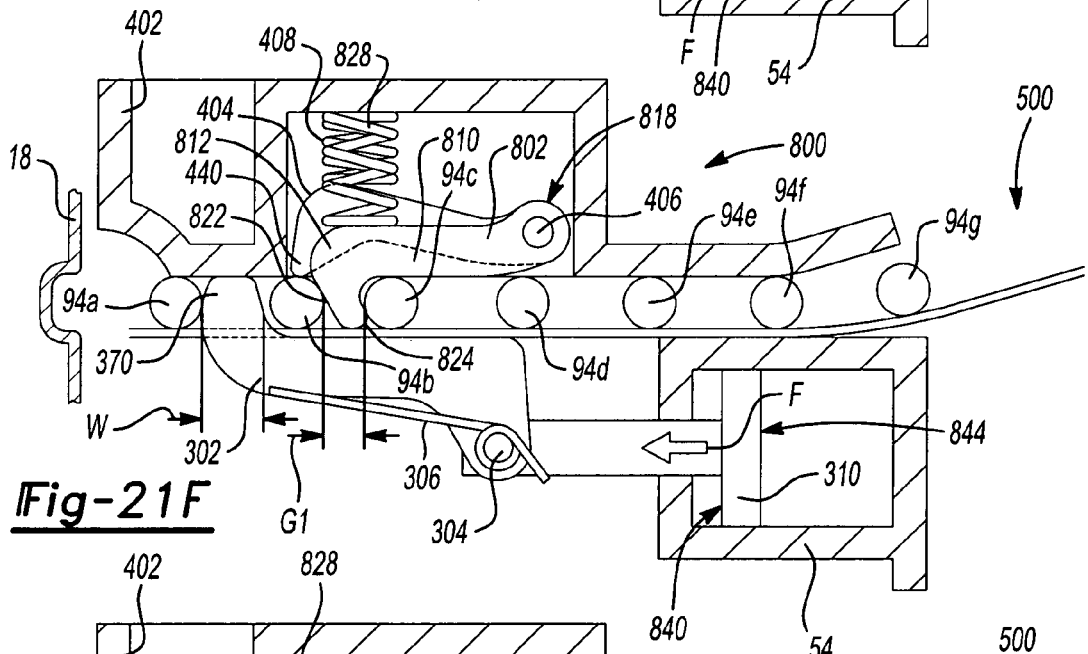
Figure 21G:
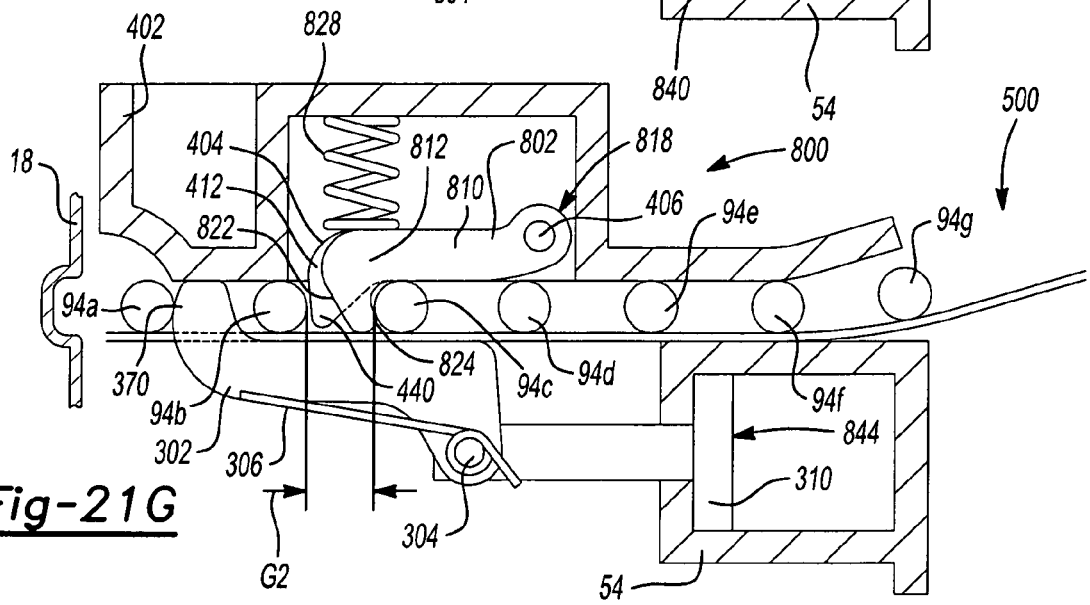

In sum, FIGS. 21C-21G illustrate a feed motion of the feed pawl 302. The feed pawl 302 moves in a feed direction F (FIG. 21C) whereby the feed pawl 302 may urge the fastener 94*a* into the nosepiece 18 and into a position to be fired (FIG. 21G). Movement of the feed pawl 302 in the feed direction F may be caused by pressure acting on a feed surface 844 of the feed piston 310.

As depicted in FIG. 21D, the feed pawl 302 is shown just prior to clearing the leading surface of the spreader tooth 812 and engaging a leading edge of the fastener 94*a*. Concurrently in FIG. 21D, a trailing surface of the stop tooth 440 is shown just engaging the leading edge of the fastener 94*b*. As depicted in FIGS. 21D-21F, the spreader tooth 812 of the spreader pawl 802 may ramp around the fastener 94*b*. Similarly, as depicted in FIGS. 21D-21G, the stop tooth 440 of the follower structure 404 may ramp around the fastener 94*b*.

With specific reference now to FIGS. 21F-21G, the spreader pawl 802 is shown creating a spreading action between the fasteners 94*b* and 94*c*. The operation of the spreader pawl 802 will now be described in greater detail. The spreader tooth 812 of the spreader pawl 802 is permitted to locate between the adjacent fasteners 94*b* and 94*c* in FIG. 21F. As illustrated in FIG. 21F, a gap G1 is defined between the fasteners 94*b* and 94*c*. As the feed pawl 302 is actuated in the feed direction F from FIGS. 21F to 21G, the fastener 94*a* and consequently the fastener 94*b* is urged by the feed pawl 302 toward the nosepiece 18. Concurrently, the fastener 94*c* is engaged by the trailing surface of the spreader tooth 812. The spreader tooth 812 at least partially inhibits movement of the fastener 94*c* in the feed direction F to maintain the fastener 94*c* in substantially the same position. As a result, a gap G2 is defined between the fasteners 94*b* and 94*c* in FIG. 21G.

In some instances, the gap G1 as depicted in FIG. 21F may be insufficient to accept the primary feed tooth 370 (or more specifically the feed tooth width W) of the feed pawl 302. In such an event, the feed pawl 302 may become jammed and require the operator to gain access to the feed pawl 302 and related fasteners 94 of the coil 500 to rectify the problem. The gap G2 created by the spreader pawl 802 is greater than the gap G1. As a result, the feed pawl 302 may provide adequate clearance for the feed tooth width W to locate between the fasteners 94*b* and 94*c* (and subsequent adjacent fasteners) during operation. As illustrated in FIG. 21G, the feed piston 310 may be fully actuated in the feed cylinder 54. The feed sequence may then be repeated.

While not specifically shown in FIGS. 21A-21G, the coil or ribbon material connecting the fasteners 94 in the coil of fasteners 500 (see. e.g. FIG. 10) may become non-linear or partially deformed. As a result, adjacent fasteners (such as fasteners 94*b* and 94*c* in FIG. 21F) may become too close together and encourage jamming of the feed pawl 302. The spreader pawl 802 is operable to widen the gap between adjacent fasteners 94 and as a result, move the coil or ribbon material into a more linear orientation having a greater span.

With reference now to FIGS. 22A-22G, another feeder pawl assembly constructed in accordance to the present invention is shown and generally identified at reference 900. The feeder pawl assembly 900 may include the feed pawl 302, the follower structure 404 and a spreader pawl. As illustrated, the feed pawl 302 and the follower structure 404 configuration may be similar to those described for the feeder pawl assembly 800 in FIGS. 21A-21G. Accordingly, like reference numerals used for the feed pawl 302, follower structure 404 as well as other components in FIGS. 21A-21G will be used to designate like components.

The spreader pawl 902 may include a body portion 910 having a first end, a spreader tooth 912 disposed on an intermediate portion, and a pivot joint 918 arranged on a second end. The spreader tooth 912 may generally define a leading surface 922 and a trailing surface 924. The trailing surface 924 may be generally perpendicular relative to a longitudinal axis of the body portion 910. As will become appreciated from the following discussion, the spreader pawl 902 can be adapted to spread adjacent fasteners 94 of the coil of fasteners 500 a predetermined distance to resist jamming of the fastening tool 10 as fasteners 94 are sequentially fed into the nosepiece 18 during operation.

Figure 22A:
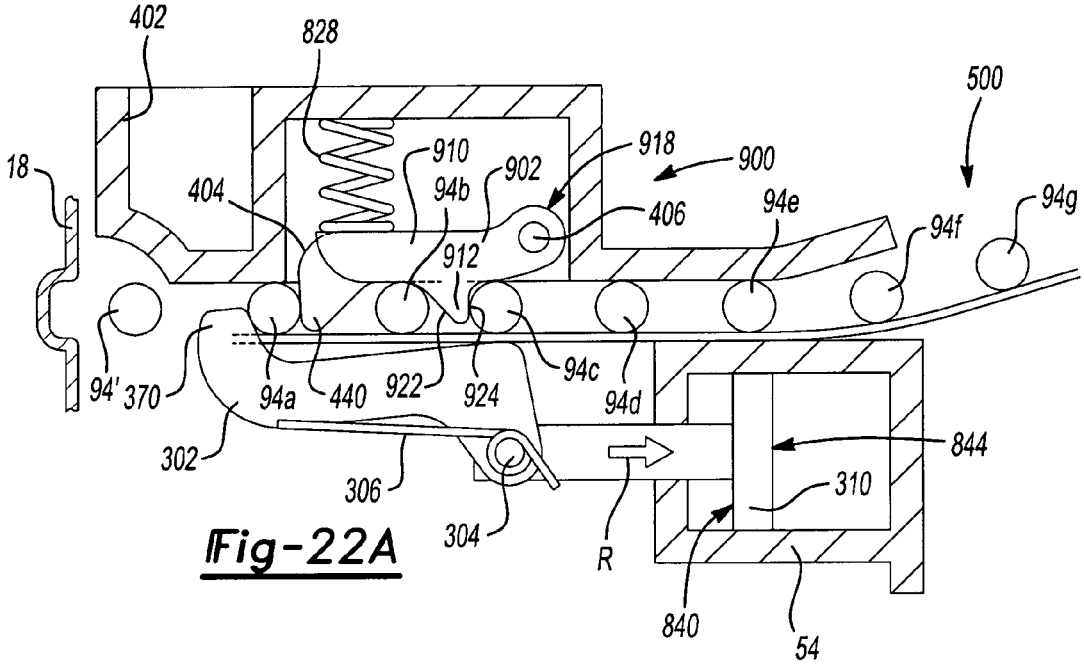
FIGS. 22A-22G illustrate a feeder pawl assembly constructed according to additional features of the present invention.
Figure 22B:
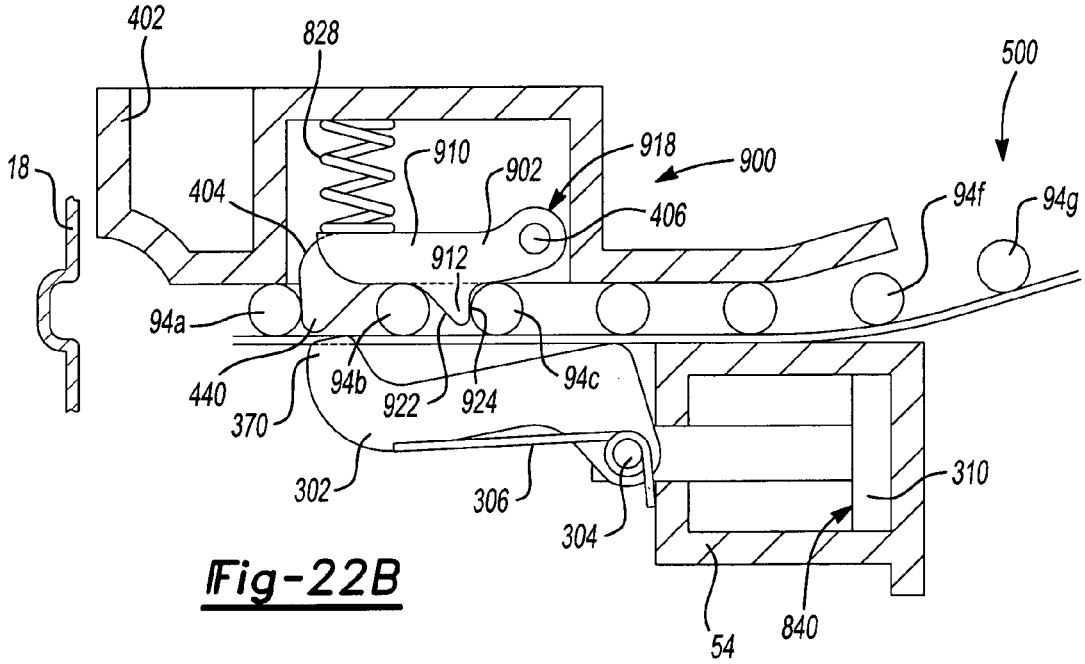

FIGS. 22A-22G depict operation of the feeder pawl assembly 900 through an exemplary feed sequence. In FIG. 22A, the feeder pawl assembly 900 is shown just after a fastener 94' has been fired. In FIG. 22A, pressure may be applied at the rebound surface 840 of the feed piston 310 in the feed cylinder 54 causing the feed piston 310 and hence the feed pawl 302 to actuate in the retract direction R. During movement of the feed pawl 302 in the retract direction R, the contour of the primary feed tooth 370 urges the feed pawl 302 to rotate in a counterclockwise direction about the hinge pin 304 upon contact with a leading edge of the fastener 94*a* (from FIG. 22A to FIG. 22B). Concurrently, the contour of the stop tooth 440 may urge against a trailing edge of the fastener 94*a* to preclude the feed pawl 302 from pulling the fastener 94*a* in the retract direction R. The contour of the stop tooth 440 and the biasing force of the follower biasing spring 408 may cooperate to maintain the stop tooth 440 in a static position (from FIG. 22A to FIG. 22B). In FIG. 22B, the feed piston 310 is shown fully retracted in the feed cylinder 54.

Figure 22C:
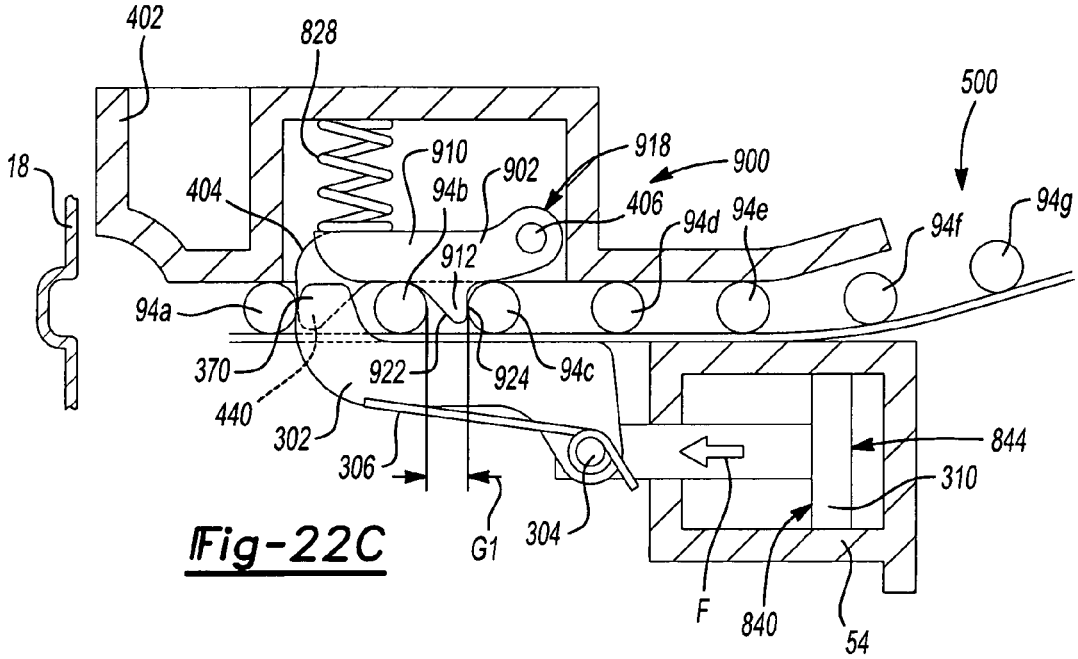

As depicted in FIGS. 22B-22C, the primary feed tooth 370 of the feed pawl 302 is shown locating between the fasteners 94*a* and 94*b*. Notably, the spreader pawl 902 may be configured to operate independent of contact with the feed pawl 302. More specifically, the first end of the spreader pawl 902 may be offset and free from contact with the feed pawl 302 (FIG. 22C). As described above, the stop tooth 440 may be arranged in an offset relationship from the feed pawl 302 whereby the feed pawl 302 does not engage the stop tooth 440 of the follower structure 404 (FIG. 22C). In FIG. 22C, the feed pawl 302 is shown engaging the trailing edge of the fastener 94*a*. Furthermore, the trailing surface 924 of the spreader pawl 902 is positioned against a leading edge of the fastener 94*c*.

Figure 22D:
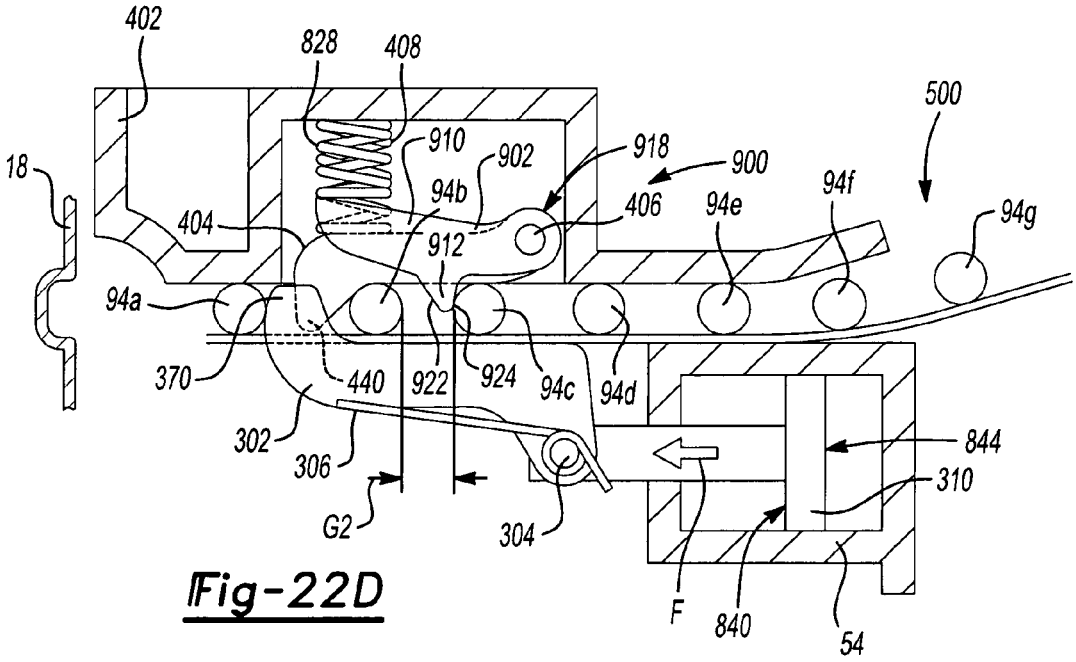
Figure 22E:
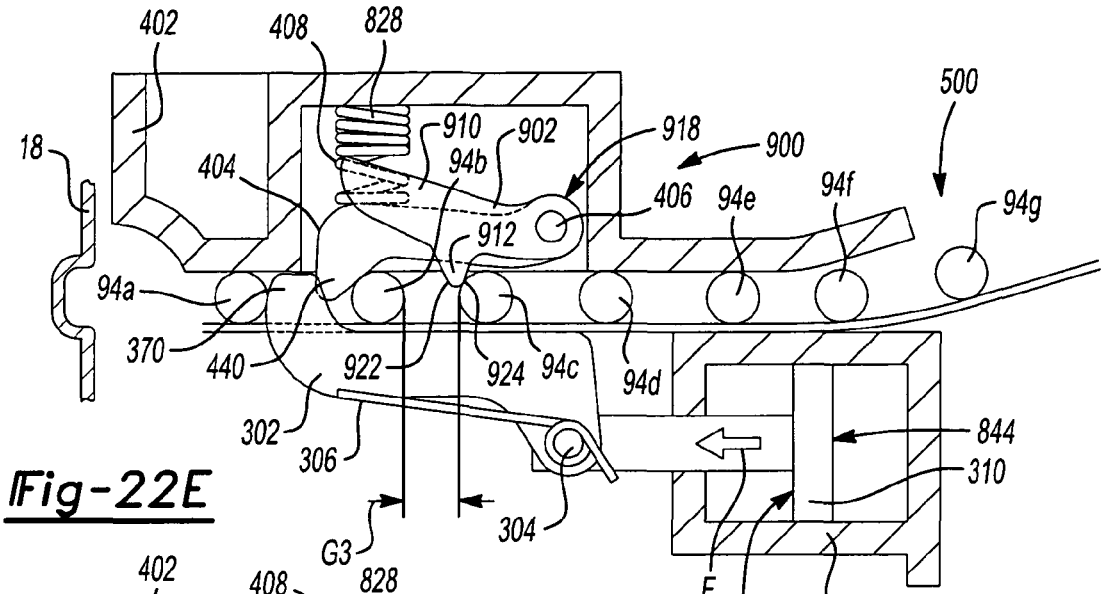
Figure 22F:
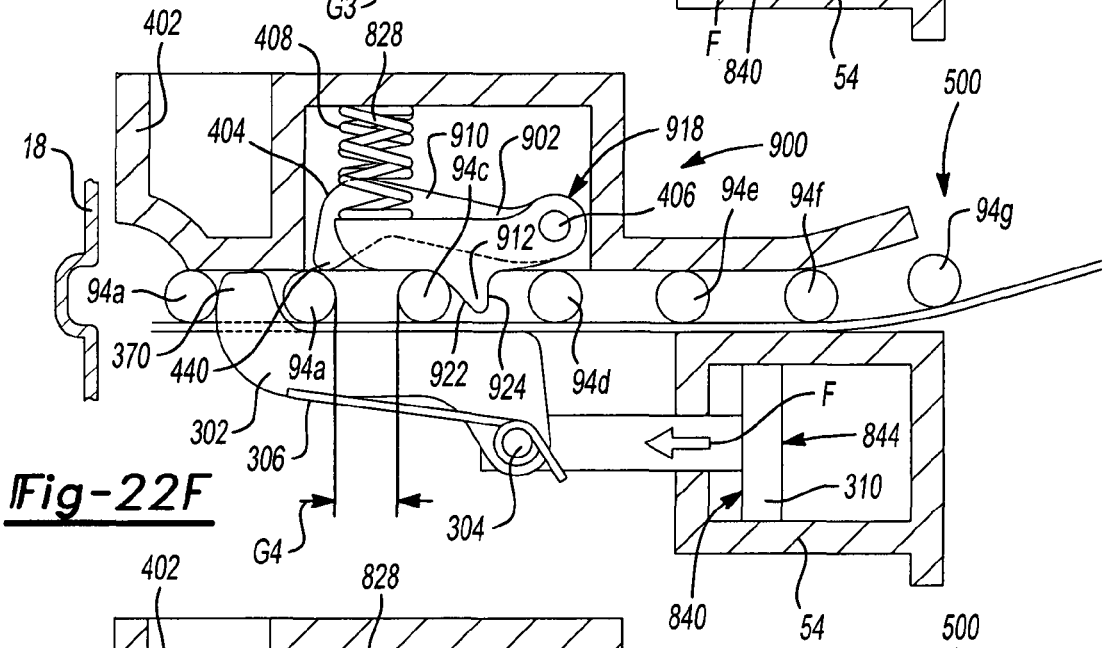
Figure 22G:
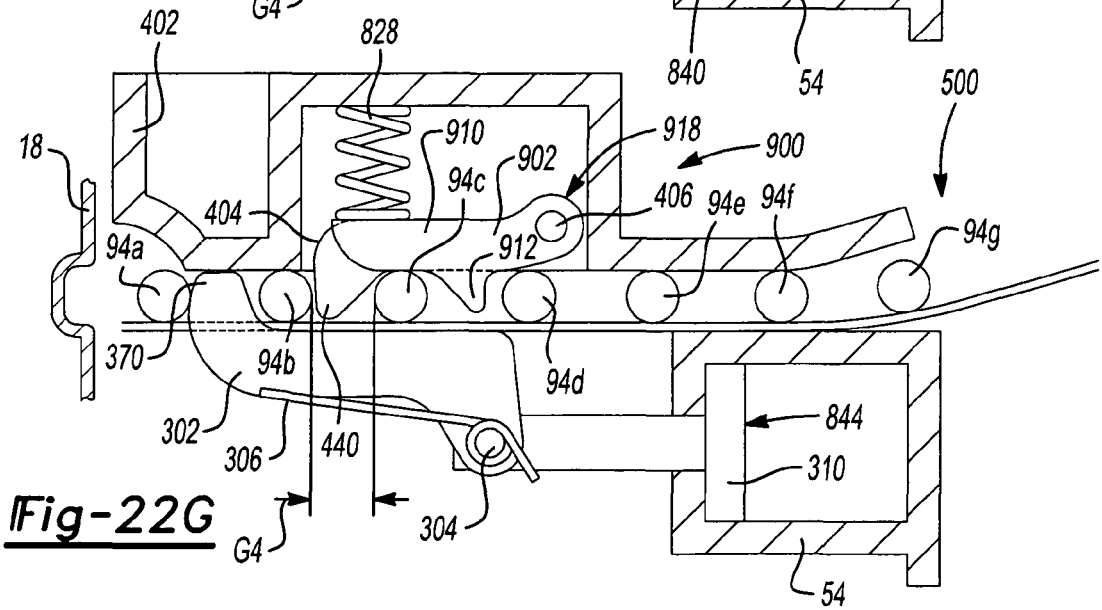

In sum, FIGS. 22C-22G illustrate a feed motion of the feed pawl 302. The feed pawl 302 moves in a feed direction F whereby the feed pawl 302 may urge the fastener 94*a* into the nosepiece 18 and into a position to be fired (FIG. 22G). Movement of the feed pawl 302 in the feed direction F may be caused by pressure acting on the feed surface 844 of the feed piston 310.

With specific reference now to FIGS. 22C-22E, the spreader pawl 902 is shown creating a spreading action between the fasteners 94*b* and 94*c*. The operation of the spreader pawl 902 will now be described in greater detail. The spreader tooth 912 of the spreader pawl 902 is permitted to locate between the adjacent fasteners 94*b* and 94*c* subsequent to a firing event (FIGS. 22A-22C). As illustrated in FIG. 22C, a gap G1 is defined between the fasteners 94*b* and 94*c*. As the feed pawl 302 is actuated in the feed direction F from FIGS. 22C-22E, the fastener 94*a* and consequently the fastener 94*b* may be urged by the feed pawl 302 toward the nosepiece 18. Concurrently, the trailing surface 924 of the spreader pawl 902 may ramp over the fastener 94*c*.

The ramping action of the spreader pawl 902 on the fastener 94*c* may at least partially inhibit movement of the fastener 94*c* in the feed direction F. As a result, a gap between the fasteners 94*b* and 94*c* may be widened by the ramping action of the spreader pawl 902 on the fastener 94*c*. More specifically, the first gap G1 may be defined between the fasteners 94*b* and 94*c* in FIG. 22C. A second gap G2 may be defined between the fasteners 94*b* and 94*c* in FIG. 22D. A third gap G3 may be defined between the fasteners 94*b* and 94*c* in FIG. 22E. A fourth gap G4 may be defined between the fasteners 94B and 94C in FIG. 22F. As shown, the respective gaps G1-G4 may become progressively wider, or more specifically G1<G2<G3<G4.

In FIGS. 22F to 22G, the spreader tooth 912 of the spreader pawl 902 is shown sliding between the fasteners 94*c* and 94*d* with assistance from the biasing force of the spreader biasing spring 828. At this point, the piston 310 may be fully actuated in the feed cylinder 54. The feed sequence may then be repeated.

As explained above, in some instances, the gap G1 as depicted in FIG. 22C may be insufficient to accept the primary feed tooth 370 of the feed pawl 302. The gap G4 created by the spreader pawl 902 may provide adequate clearance between adjacent fasteners 94 to accept the feed tooth 912 therebetween during operation.

While the invention has been described in the specification and illustrated in the drawings with reference to various embodiments, it will be understood by those skilled in the art that various changes may be made and equivalents may be substituted for elements thereof without departing from the scope of the invention as defined in the claims. Furthermore, the mixing and matching of features, elements and/or functions between various embodiments is expressly contemplated herein so that one of ordinary skill in the art would appreciate from this disclosure that features, elements and/or functions of one embodiment may be incorporated into another embodiment as appropriate, unless described otherwise, above. Moreover, many modifications may be made to adapt a particular situation or material to the teachings of the invention without departing from the essential scope thereof. Therefore, it is intended that the invention not be limited to the particular embodiment illustrated by the drawings and described in the specification as the best mode presently contemplated for carrying out this invention, but that the invention will include any embodiments falling within the foregoing description and the appended claims.

What is claimed is:

1. A fastening tool comprising:

a housing assembly having a nosepiece;

a magazine assembly coupled to the housing assembly, the magazine assembly including a canister, the canister being configured to hold a plurality of collated fasteners; and a feeder pawl assembly coupled to the magazine assembly and including a feed pawl and a spreader pawl, the feed pawl movable to engage a first fastener of the collated fasteners and advance the first fastener into the nosepiece during a feed motion, the spreader pawl locating between a pair of subsequent fasteners of the collated fasteners and at least partially inhibiting movement of one of the subsequent fasteners toward the nosepiece during the feed motion.

2. The fastening tool of claim 1 wherein the spreader pawl includes a body portion having a finger portion extending therefrom, the finger portion configured to engage the second fastener during the feed motion.

3. The fastening tool of claim 2 wherein the spreader pawl is pivotal between an engaged position wherein the finger portion impedes movement of the second fastener toward the nosepiece and a disengaged position wherein the finger portion permits movement of the second fastener toward the nosepiece, and wherein said spreader pawl is biased toward the engaged position.

4. The fastening tool of claim 3 wherein the feed pawl is movable in a retract direction whereby the feed pawl engages the spreader pawl and pivots the spreader pawl into the disengaged position.

5. The fastening tool of claim 3 wherein the finger portion of the spreader pawl is configured to ramp over the second fastener and thereby partially inhibit movement of the second fastener toward the nosepiece during the feed motion.

6. A fastening tool comprising:

a housing assembly having a nosepiece;

a plurality of collated fasteners;

a magazine assembly coupled to the housing assembly, the magazine assembly including a canister, the canister being configured to hold the plurality of collated fasteners; and a feeder pawl assembly coupled to the magazine assembly and comprising:

a feed pawl having a feed tooth for locating a feed tooth width between a first pair of adjacent fasteners, the feed tooth operable in a feed direction to advance a fastener of the first pair toward the nosepiece during a feed motion; and a spreader pawl having a spreader tooth adapted to locate between a first gap defined between a second pair of adjacent fasteners, the first gap being smaller than the feed tooth width, the spreader pawl resisting movement of an engaged fastener of the second pair in the feed direction during the feed motion and thereby defining a second gap between the second pair of adjacent fasteners, the second gap having a space suitable to accept the feed tooth width of the feed tooth therebetween.

7. The fastening tool of claim 6 wherein the spreader pawl includes a body portion having a tooth portion extending therefrom, the tooth portion configured to engage the engaged fastener of the second pair during the feed motion.

8. The fastening tool of claim 7 wherein the spreader pawl is pivotal between an engaged position wherein the tooth portion impedes movement of the engaged fastener of the second pair toward the nosepiece and a disengaged position wherein the tooth portion permits movement of the engaged fastener of the second pair toward the nosepiece, and wherein the spreader pawl is biased toward the engaged position.

9. The fastening tool of claim 8 wherein the feed pawl is movable in a retract direction whereby the feed pawl engages the spreader pawl and pivots the spreader pawl into the disengaged position.

10. The fastening tool of claim 8 wherein the tooth portion of the spreader pawl is adapted to ramp over the engaged fastener and thereby partially inhibit movement of the engaged fastener toward the nosepiece during the feed motion.

* * * * *